US009259081B2

(12) United States Patent
Rassat

(10) Patent No.: US 9,259,081 B2
(45) Date of Patent: Feb. 16, 2016

(54) FURNITURE LINE AND METHOD AND SYSTEM FOR PROVIDING CUSTOMIZATION THEREOF

(71) Applicant: Attiture LLC, Minneapolis, MN (US)

(72) Inventor: David F. Rassat, Minneapolis, MN (US)

(73) Assignee: Attiture LLC, Minneapolis, MN (US)

( * ) Notice: Subject to any disclaimer, the term of this patent is extended or adjusted under 35 U.S.C. 154(b) by 0 days.

(21) Appl. No.: 14/279,543

(22) Filed: May 16, 2014

(65) Prior Publication Data

US 2014/0338573 A1 Nov. 20, 2014

Related U.S. Application Data

(60) Provisional application No. 61/824,046, filed on May 16, 2013.

(51) Int. Cl.

| | |
|---|---|
| ***A47B 13/00*** | (2006.01) |
| ***A47B 13/02*** | (2006.01) |
| ***A47C 5/04*** | (2006.01) |
| ***A47C 7/00*** | (2006.01) |
| *A47B 13/10* | (2006.01) |
| *A47B 13/16* | (2006.01) |
| *A47B 37/04* | (2006.01) |
| *A47B 91/02* | (2006.01) |

(52) U.S. Cl.

CPC ..... *A47B 13/021* (2013.01); *A47C 5/04* (2013.01); *A47C 7/00* (2013.01); *A47B 13/10* (2013.01); *A47B 13/16* (2013.01); *A47B 37/04* (2013.01); *A47B 91/02* (2013.01); *A47B 2013/022* (2013.01); *A47B 2013/024* (2013.01); *A47B 2013/026* (2013.01); *A47B 2200/0085* (2013.01)

(58) Field of Classification Search

CPC ..... A47B 13/10; A47B 83/04; A47B 13/08; A47B 13/083; A47B 2013/003; A47B 2013/006; A47B 2013/02; A47B 2013/026; A47B 2013/023; A47B 2200/0014; A47B 2200/0015; A47B 2200/0017; A47B 2200/0032

USPC ..... 108/50.12, 151, 155

See application file for complete search history.

(56) References Cited

U.S. PATENT DOCUMENTS

| | | | | |
|---|---|---|---|---|
| 1,162,148 | A | | 11/1915 | Dunlap |
| 1,940,565 | A | | 12/1933 | Schott |
| 1,951,499 | A | | 3/1934 | Brown |
| 2,838,351 | A | | 6/1958 | Siconolfi et al. |
| D185,305 | S | | 5/1959 | Molla |
| 3,032,380 | A | | 5/1962 | Danciart et al. |
| D192,999 | S | | 6/1962 | Hastings et al. |
| D194,037 | S | | 11/1962 | Reineman et al. |
| 3,074,771 | A | | 1/1963 | Wilson |
| 3,215,381 | A | * | 11/1965 | Ching ..... 248/167 |
| 3,312,438 | A | | 4/1967 | Goetz et al. |

(Continued)

*Primary Examiner* — Daniel Rohrhoff

(74) *Attorney, Agent, or Firm* — Leydig, Voit & Mayer, Ltd.

(57) ABSTRACT

A furniture line featuring a table which is customizable and suited for confined and irregular spaces such as balconies, decks or outdoors which line can be easily assembled or disassembled essentially by hand and available affordably with a variety of selectable tops, shapes and applications. The table features a skeletal frame arrangement with universal top mounts, selectable curved tubular or rod like legs, at least one and preferably two hub couplers or tubular leg and pedestal base, and optional rotatable or slide on levelers for uneven surfaces. A method and system disclosed provides purchaser customization of the table and complementary ensembles.

3 Claims, 42 Drawing Sheets

(56) References Cited

U.S. PATENT DOCUMENTS

| | | | | | |
|---|---|---|---|---|---|
| 3,366,079 | A | | 1/1968 | Koransky et al. | |
| 3,643,608 | A | | 2/1972 | DeCesaris | |
| 3,715,136 | A | | 2/1973 | Yoshida | |
| D234,932 | S | | 4/1975 | Burke et al. | |
| 3,934,519 | A | | 1/1976 | Petit | |
| 4,003,320 | A | | 1/1977 | Owens et al. | |
| 4,315,467 | A | | 2/1982 | Vanderminden | |
| 4,324,433 | A | | 4/1982 | Saiger | |
| 4,351,621 | A | | 9/1982 | Liou | |
| 4,467,730 | A | | 8/1984 | Borichevsky | |
| 4,782,764 | A | * | 11/1988 | Robinson | 108/90 |
| 4,805,541 | A | | 2/1989 | Drane et al. | |
| 4,905,611 | A | * | 3/1990 | Jung-Chung | 108/90 |
| 4,905,612 | A | * | 3/1990 | Apissomian | 108/157.15 |
| 4,941,413 | A | * | 7/1990 | Vanderminden | 108/157.15 |
| D312,540 | S | | 12/1990 | Rosen | |
| 5,249,767 | A | | 10/1993 | Mellen | |
| D346,513 | S | | 5/1994 | Weiss | |
| 5,318,260 | A | * | 6/1994 | Kemnitz | 248/188.91 |
| 5,549,265 | A | | 8/1996 | Minchey et al. | |
| D396,761 | S | | 8/1998 | Rinaldi | |
| 6,109,279 | A | | 8/2000 | Kloss et al. | |
| D436,270 | S | | 1/2001 | Kane | |
| D440,081 | S | | 4/2001 | Jeup | |
| D482,909 | S | | 12/2003 | Neggers | |
| 7,178,471 | B2 | | 2/2007 | Strong et al. | |
| 7,322,300 | B2 | | 1/2008 | Caeton | |
| 7,549,430 | B1 | * | 6/2009 | Gravlee | 135/16 |
| D608,120 | S | | 1/2010 | Smith et al. | |
| 7,717,379 | B2 | | 5/2010 | Kimmel | |
| 8,161,891 | B2 | * | 4/2012 | Palese | 108/50.01 |
| 8,408,146 | B2 | | 4/2013 | Peery et al. | |
| 8,607,715 | B2 | | 12/2013 | Catoni et al. | |
| 8,794,163 | B1 | * | 8/2014 | Shokouhi | 108/91 |
| 2004/0226487 | A1 | * | 11/2004 | Yang | 108/50.12 |
| 2006/0027148 | A1 | * | 2/2006 | Chen | 108/50.12 |
| 2006/0196396 | A1 | * | 9/2006 | Rivera et al. | 108/157.1 |
| 2013/0000529 | A1 | | 1/2013 | Heyring et al. | |

* cited by examiner 75
110

23
75
23

112
75
110
75

75
112
110

75

75
114

FURNITURE LINE AND METHOD AND SYSTEM FOR PROVIDING CUSTOMIZATION THEREOF

CROSS-REFERENCE TO RELATED APPLICATION

This patent application claims the benefit of U.S. Provisional Patent Application No. 61/824,046, filed May 16, 2013, which is incorporated herein by reference.

FIELD AND BACKGROUND OF THE INVENTION

The invention relates generally to furniture articles, particularly a line of tables and complementary ensembles that are ideally suited for use on small balconies, terraces, decks or walkways and confined or even irregular shaped areas. More specifically it relates to a furniture line that offers customizable furniture items such as table top shapes, sizes, heights and uses from selectable components while maintaining low cost affordability, ease of assembly and disassembly, essentially by hand, and even use of minimal tools and loose parts.

The furniture field is replete with table constructions for indoor and outdoor uses, and they are available limited as to aesthetics and/or functionality so that purchasers have to accept what is offered or available on the market. Accordingly, there has been numerous sacrifices that had to be made either as to aesthetics, functionality, ease of assembly, costs, or suitability for the intended purpose.

It will be appreciated that this background description is merely an overview to aid the reader, and it is not to be taken as reference to particular prior art, nor, as an indication that any of the deficiencies, disadvantages, or other problems pointed out were appreciated in the art or that they were satisfactorily resolved.

BRIEF SUMMARY OF THE INVENTION

The disclosure describes, in one aspect, a furniture line featuring a customizable table having a top frame, provided selectively in a variety of geometric shapes adapted to receive tops selectable from numerous provided materials and patterns, including solid surface and grids; models with openings for umbrella poles and other accessories; an under mount cross-member coupling system to connect the top frame to a plurality of tubular or rod-like legs, either 3 or 4, in number, the legs being curved and transitioning from vertical to horizontal at upper and lower ends, at least one and preferably two hub-type leg couplers adapted to connect the legs intermediate to their ends and being easily attached and removable; and optionally provided horizontally mountable, rotatable leg levelers to provide stability on uneven surfaces. The disclosed table line provides durability, selection and customization of top shapes, sizes and varying materials, ease of assembly and disassembly, and stability in confined locations on multiple surfaces.

The disclosure also describes various improvements in the ease and versatility of attaching the components by way of alignment, securement and interchangeability providing personalized aesthetics and functions desired by users.

Finally, some of the embodiments disclose companion accessories that enhance the versatility of the table line and show the possible expansion of the features, components and aesthetics to related articles of furniture or other items of décor.

Other objects, features and advantages of the invention will become apparent and explained as the description herein proceeds when considered in connection with the accompanying illustrative drawings, and further by the accompanying claims.

BRIEF DESCRIPTION OF THE DRAWING(S)

Figure 1:
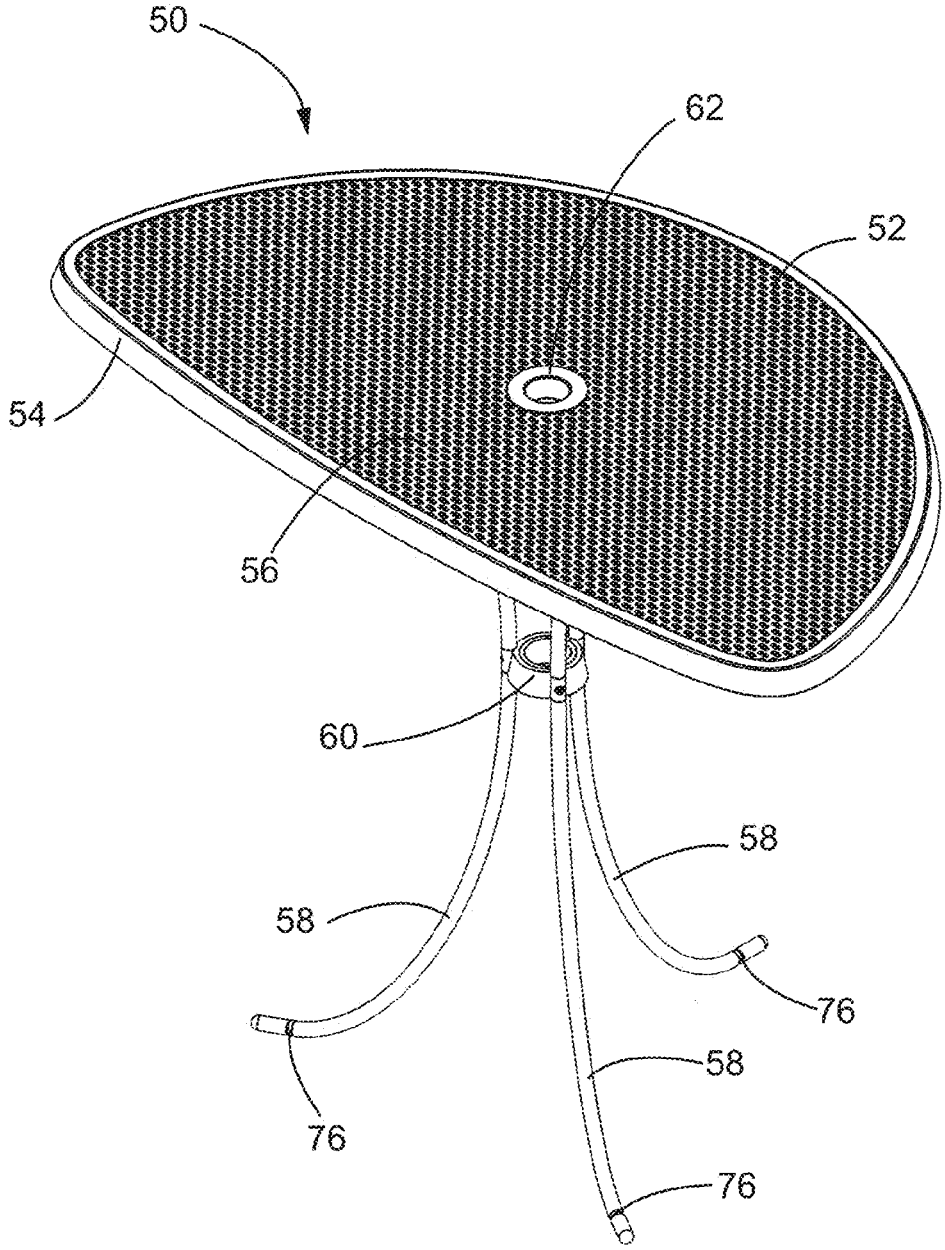
FIG. 1 is a top down perspective view of an exemplary 3 leg table constructed according to the invention herein.
Figure 2:
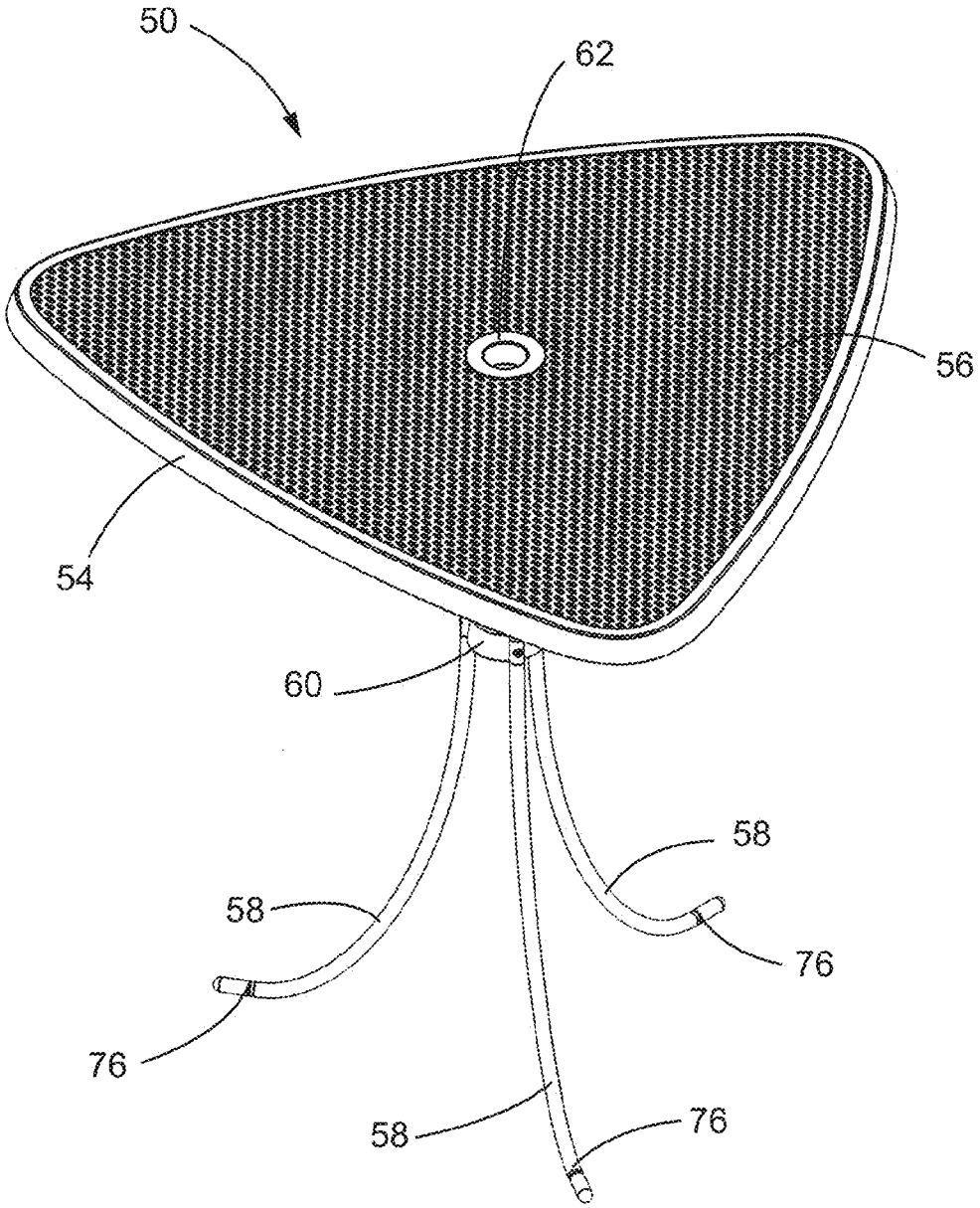
FIG. 2 is a top down perspective view of another exemplary 3 leg table.
Figure 3:
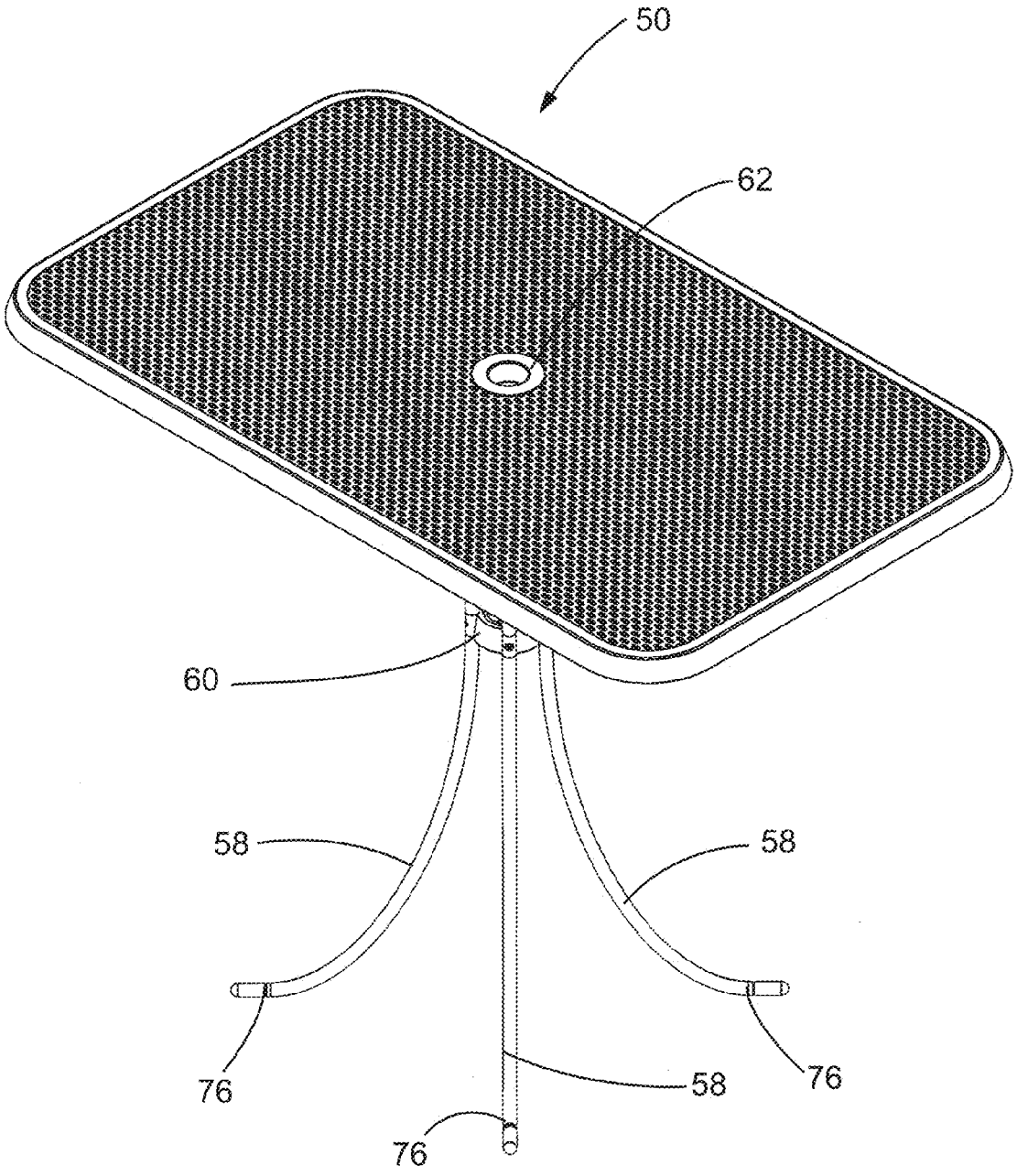
FIG. 3 is a top down perspective view of another exemplary 4 leg table.
Figure 4:
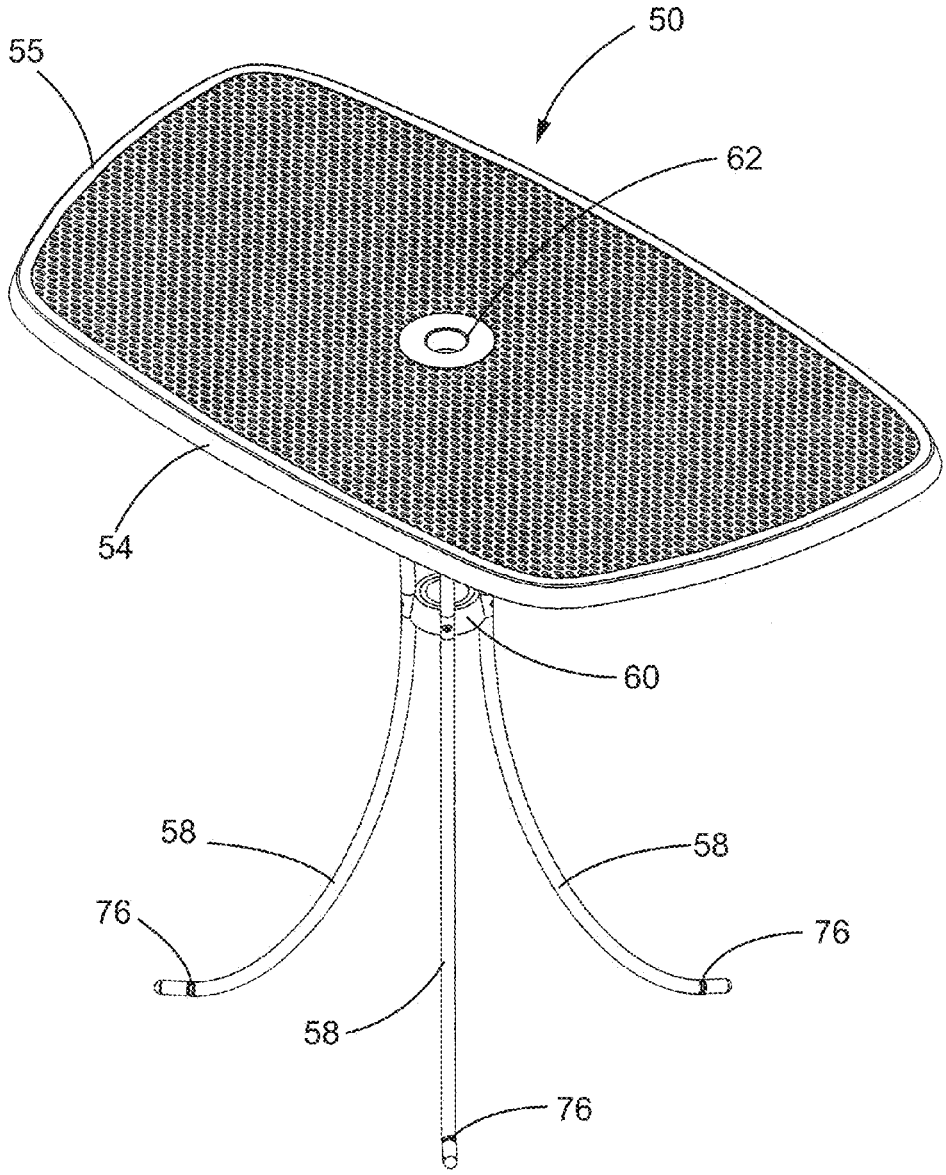
FIG. 4 is a top down perspective view of another exemplary 4 leg table.
Figure 5:
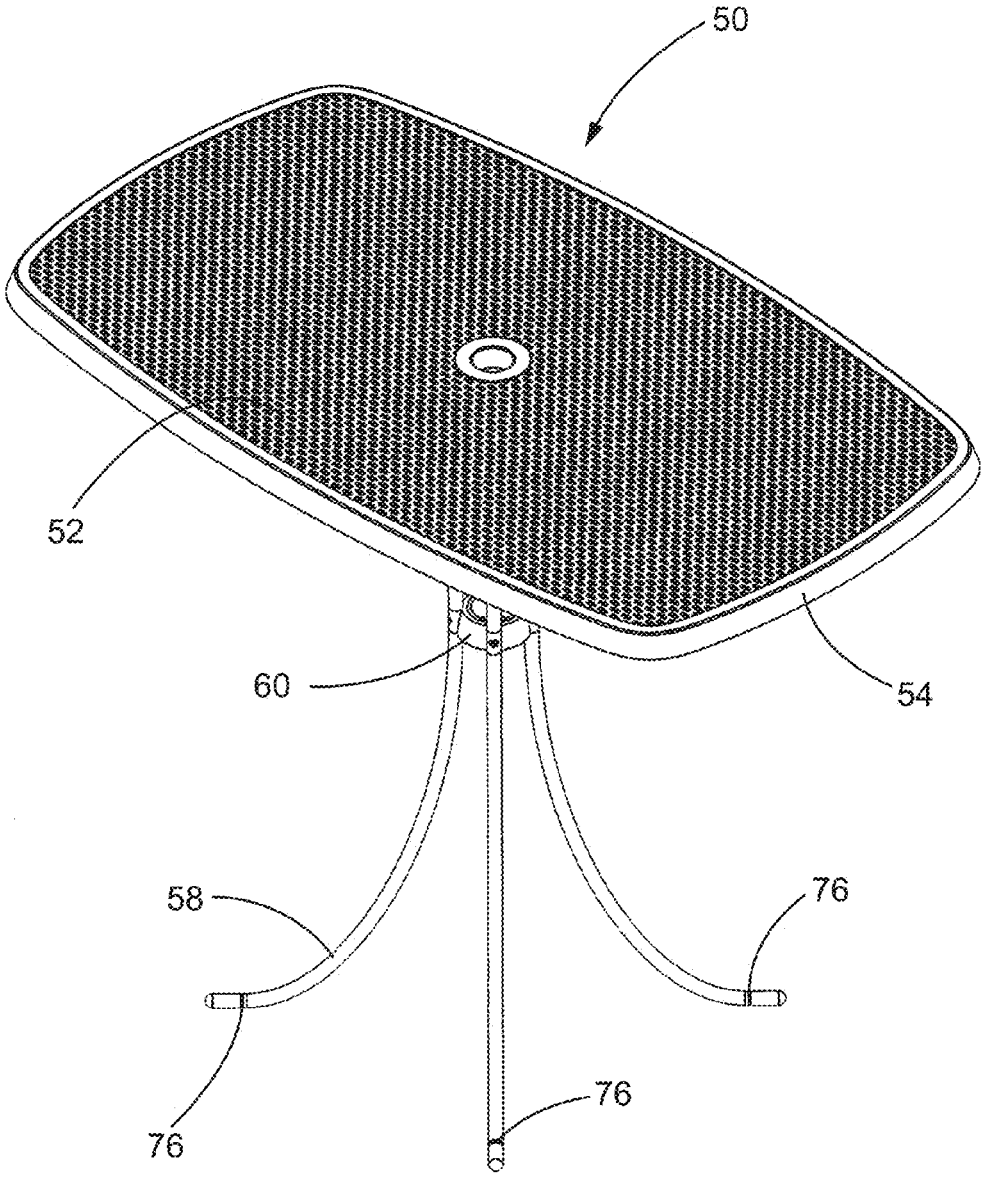
FIG. 5 is a top down perspective view of another exemplary 4 leg table.
Figure 6:
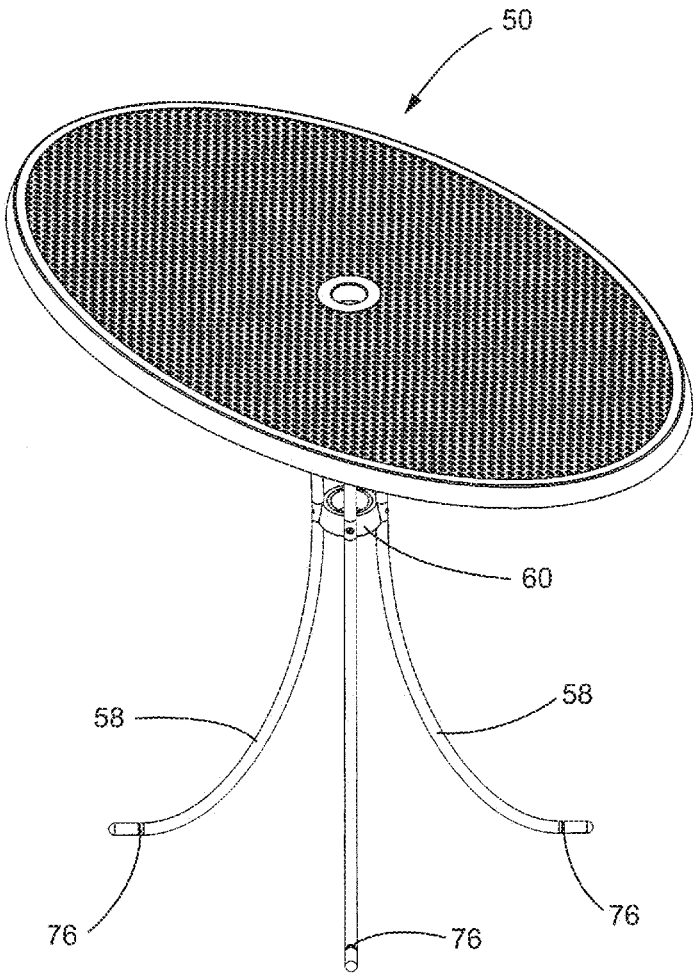
FIG. 6 is a top down perspective view of another exemplary 4 leg table.
Figure 7:
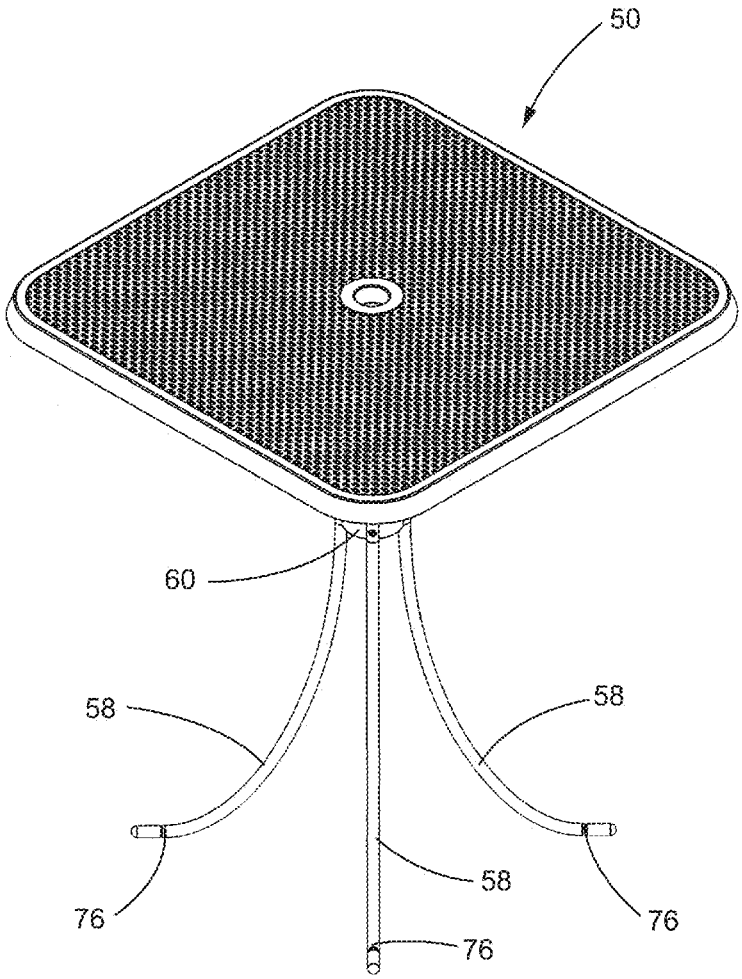
FIG. 7 is a top down perspective view of another exemplary 4 leg table.
Figure 8:
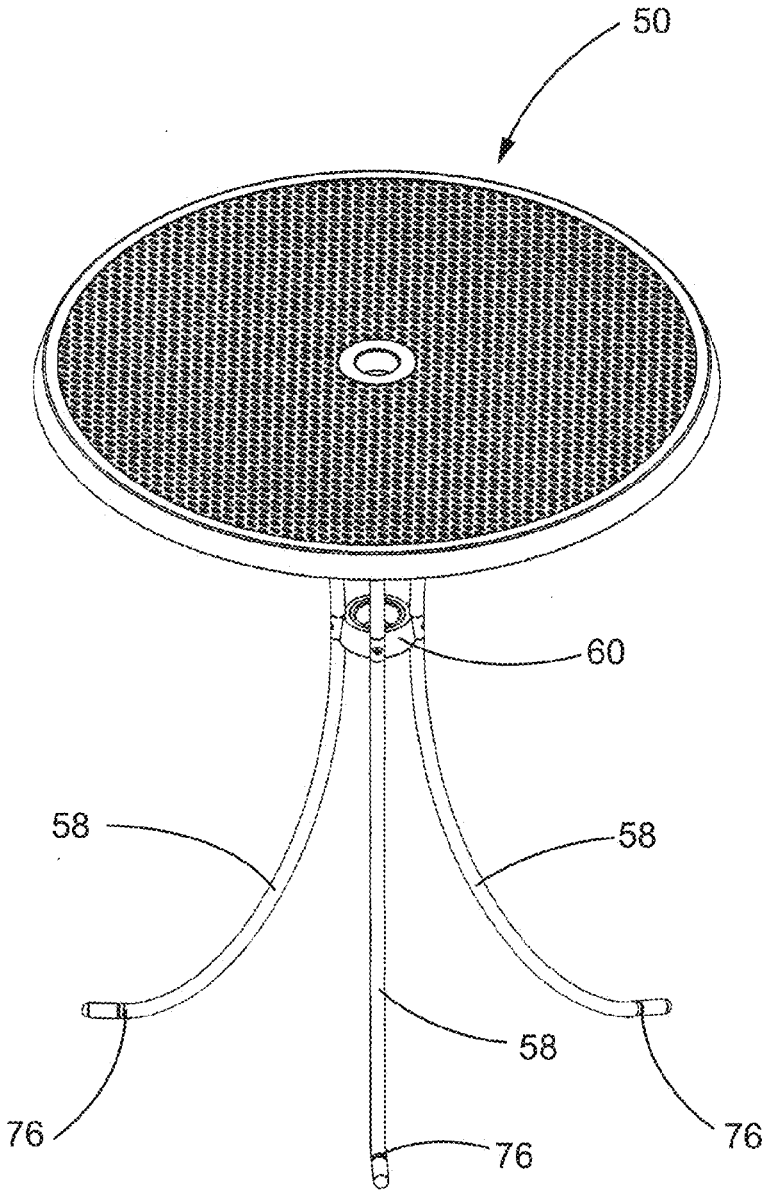
FIG. 8 is a top down perspective view of another exemplary 4 leg table.
Figure 9:
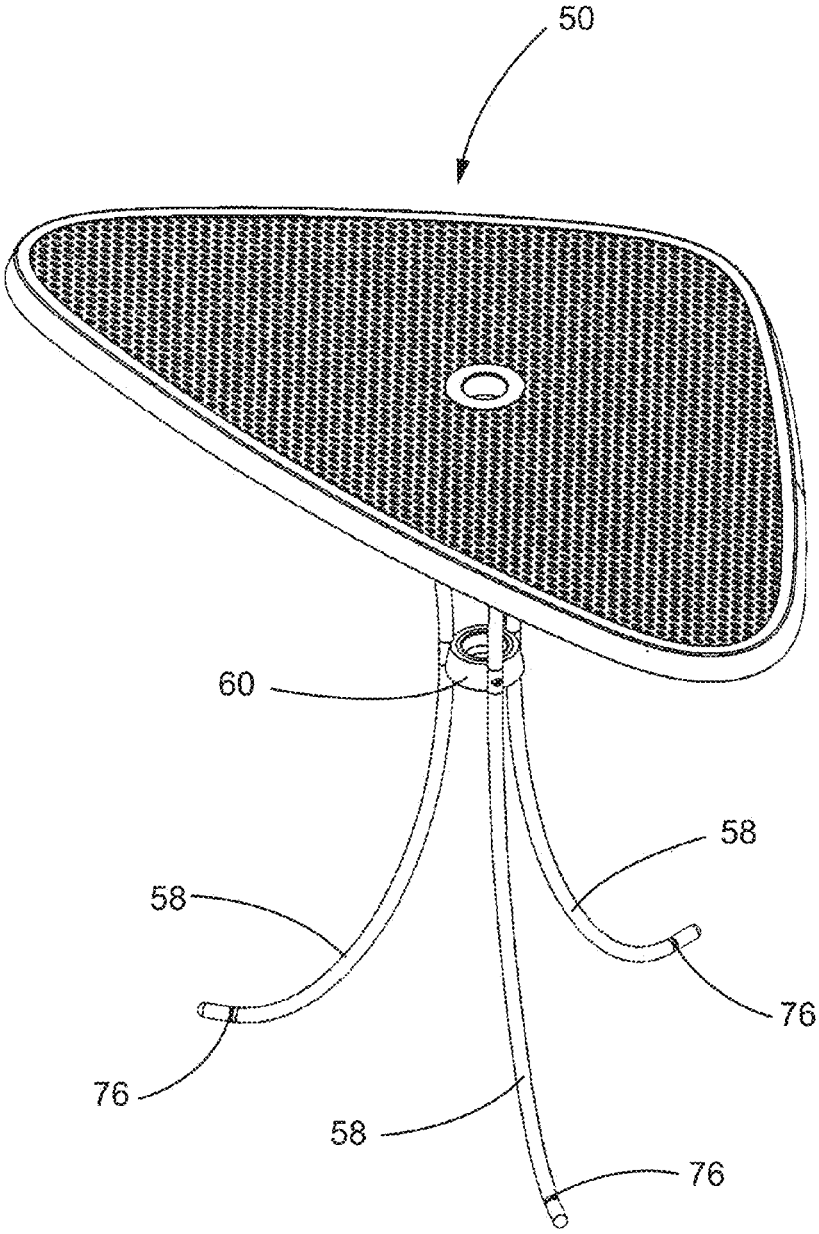
FIG. 9 is a top down perspective view of another exemplary 3 leg table.
Figure 10:
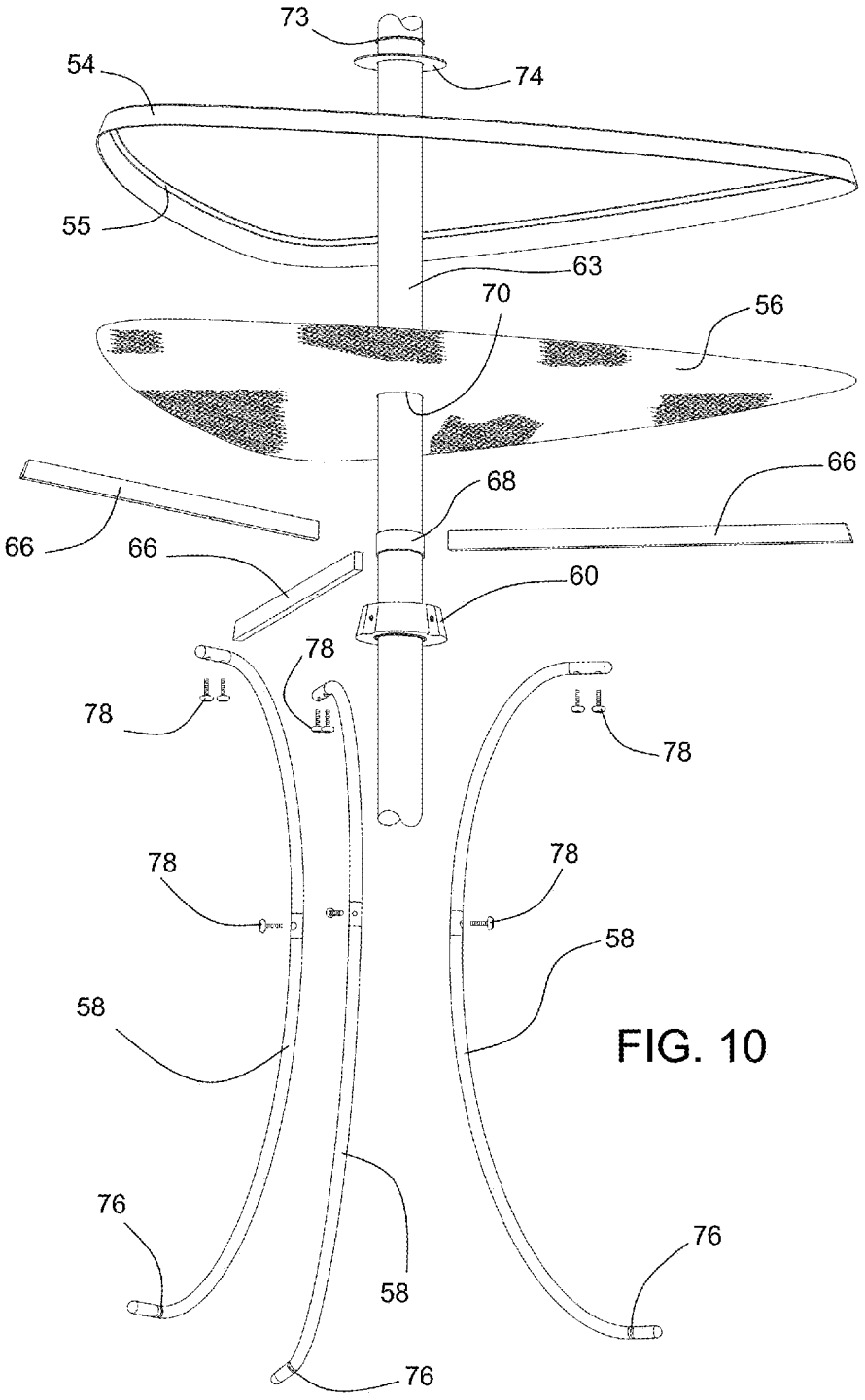
FIG. 10 is an exploded perspective view of an exemplary 3 leg table showing the components making up the table and with an umbrella pole.
Figure 10A:
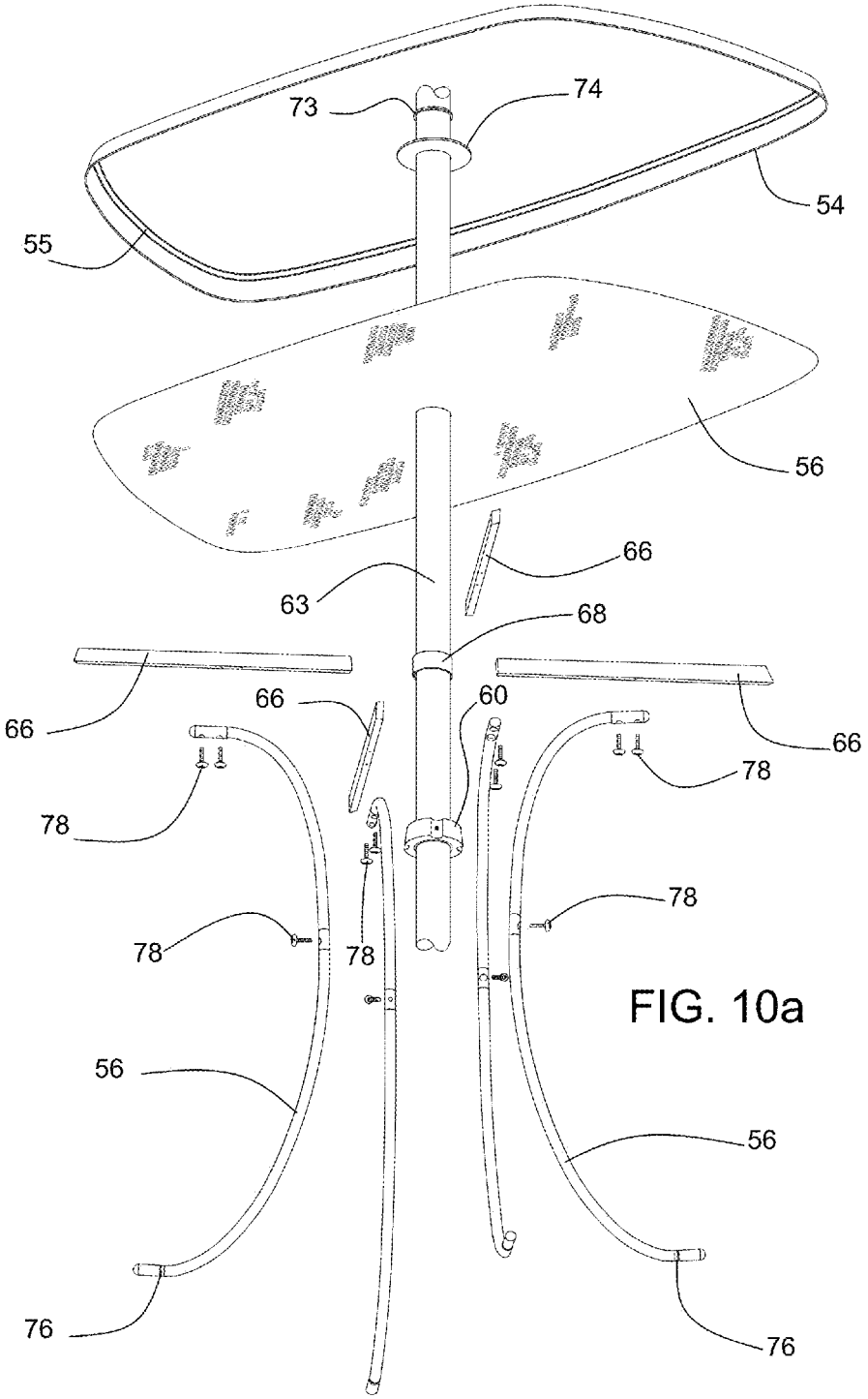
Figure 11:
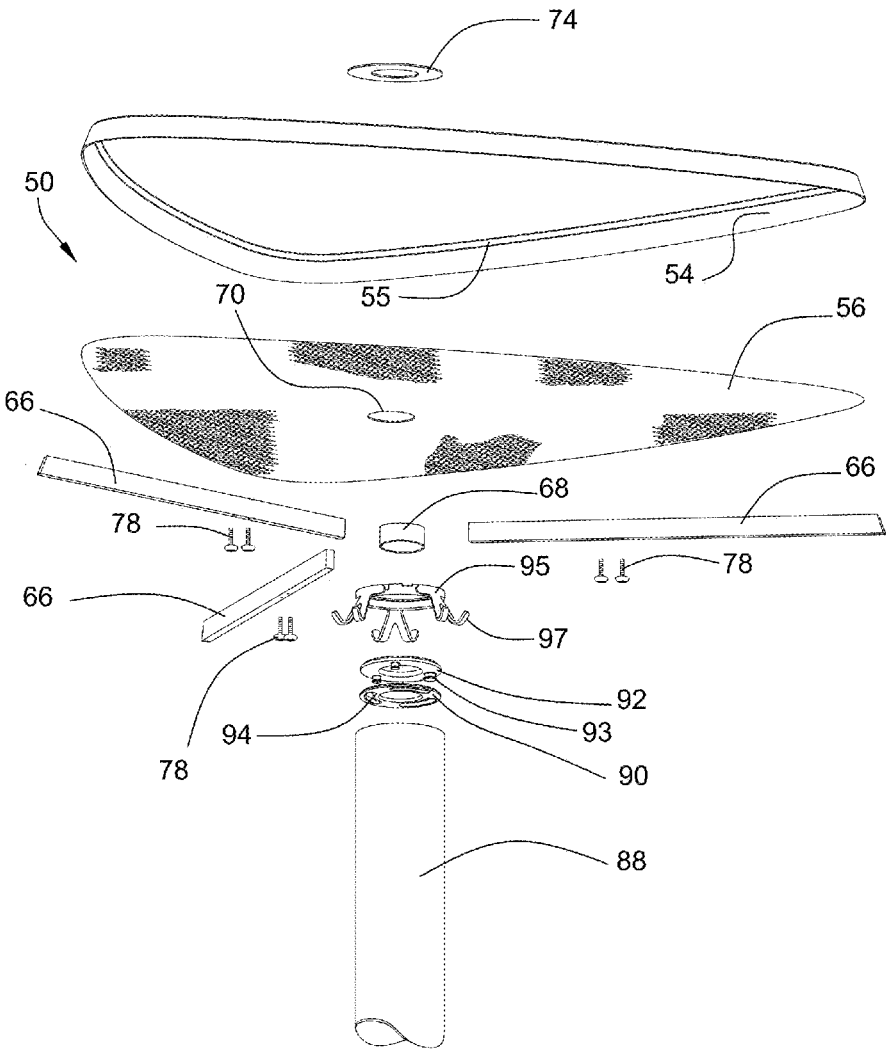
Figure 11A:
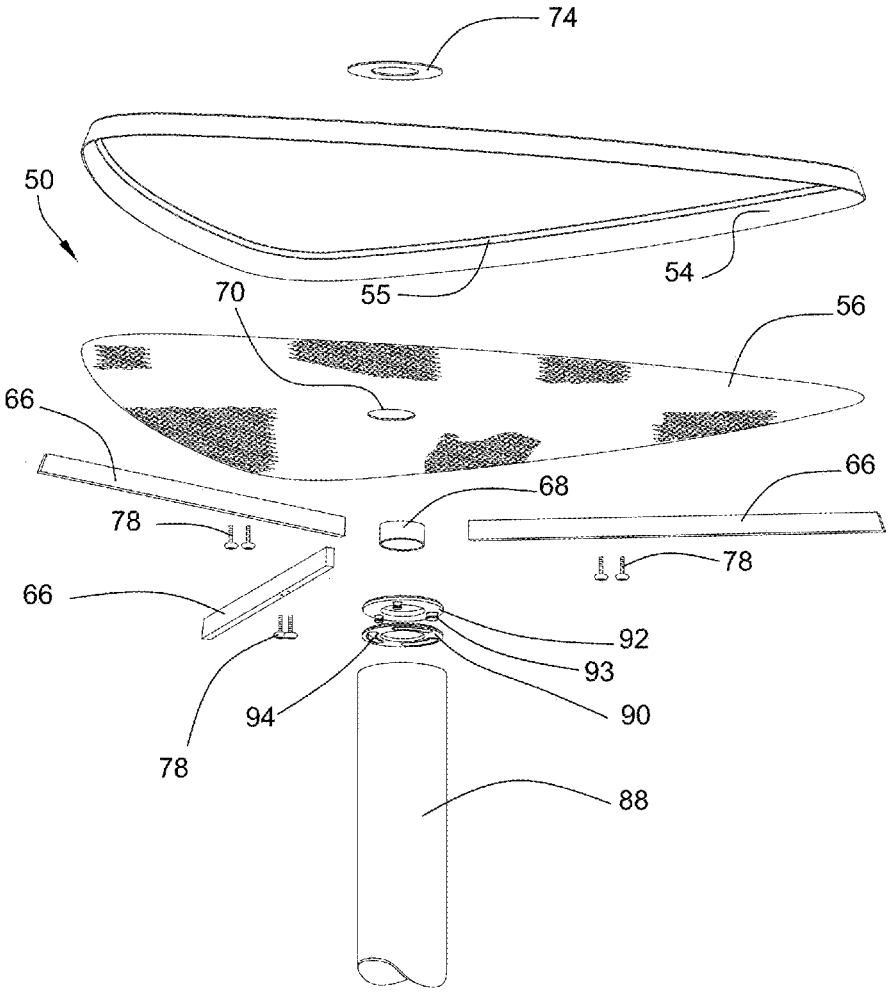
Figure 12:
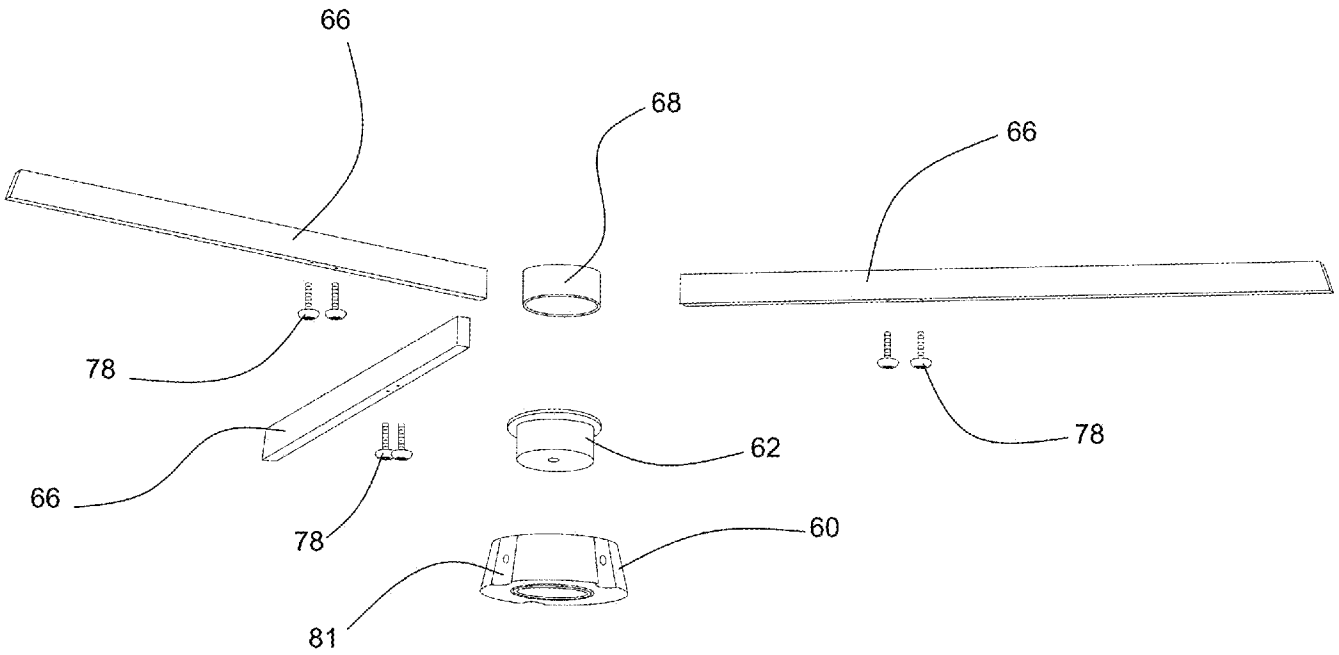
Figure 13:
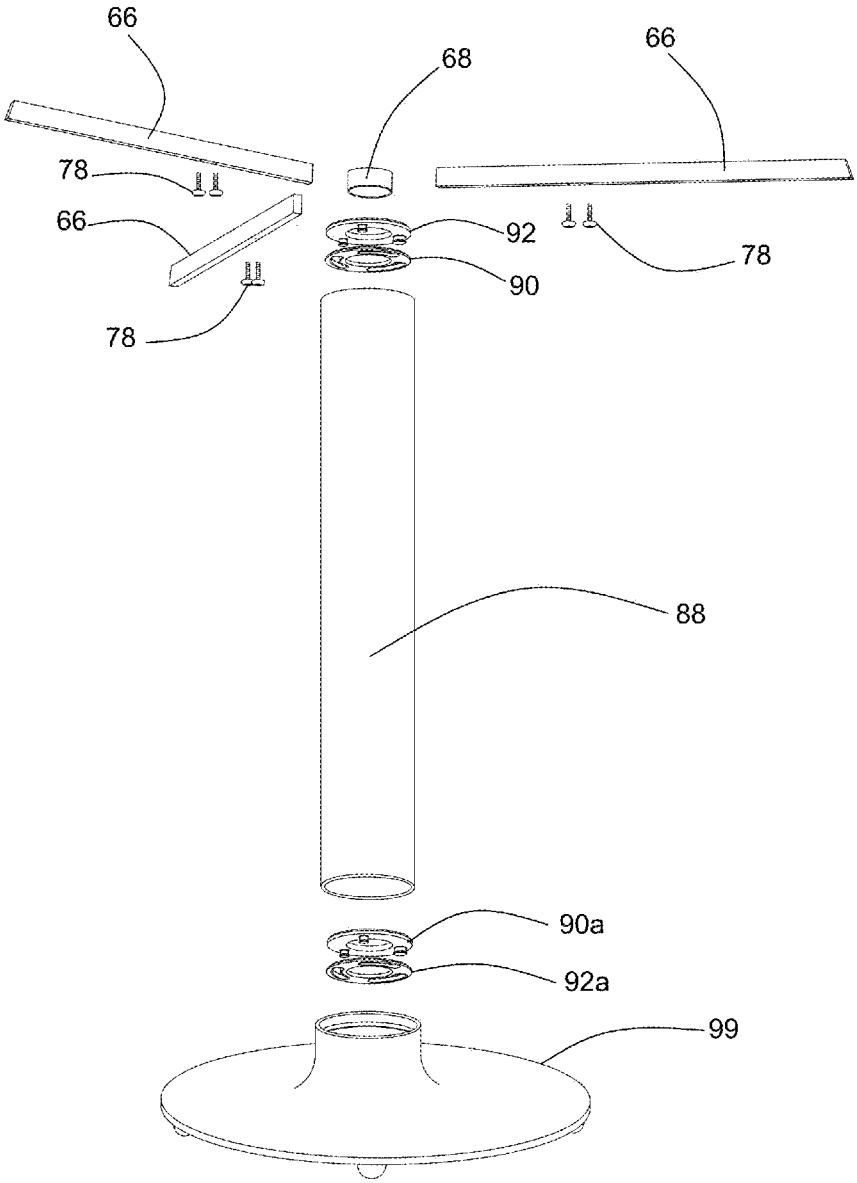
Figure 14:
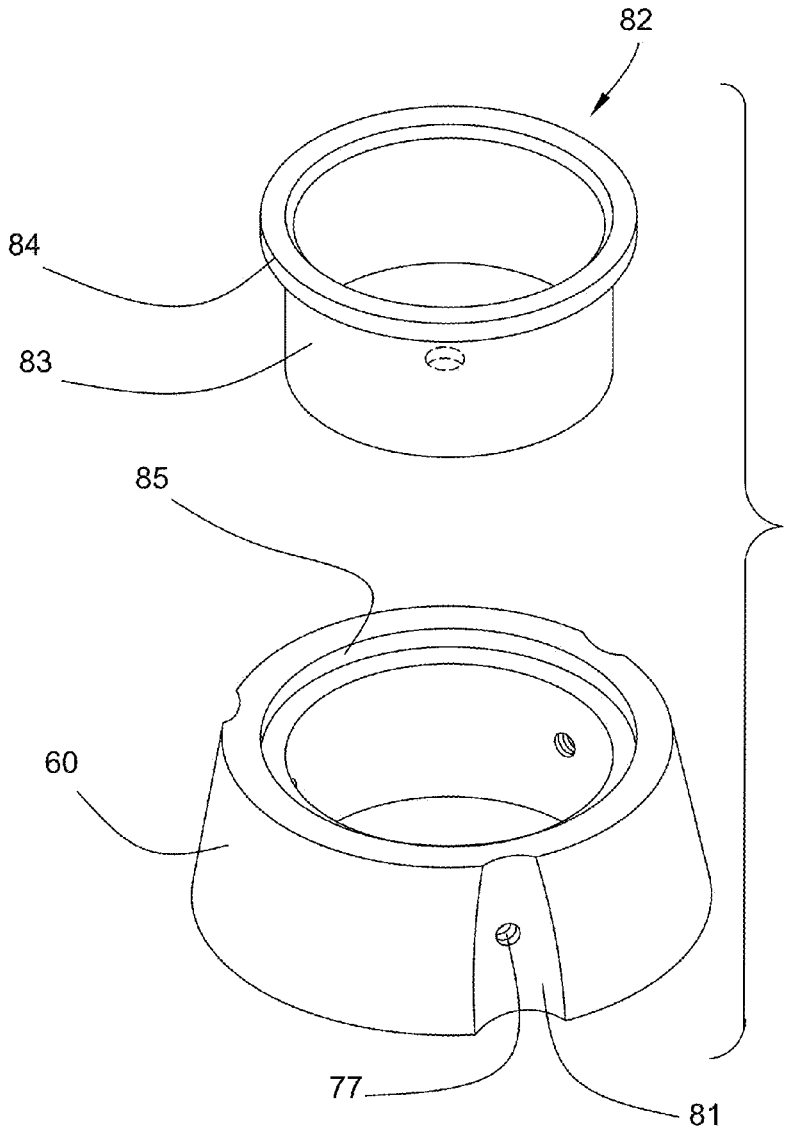
Figure 14A:
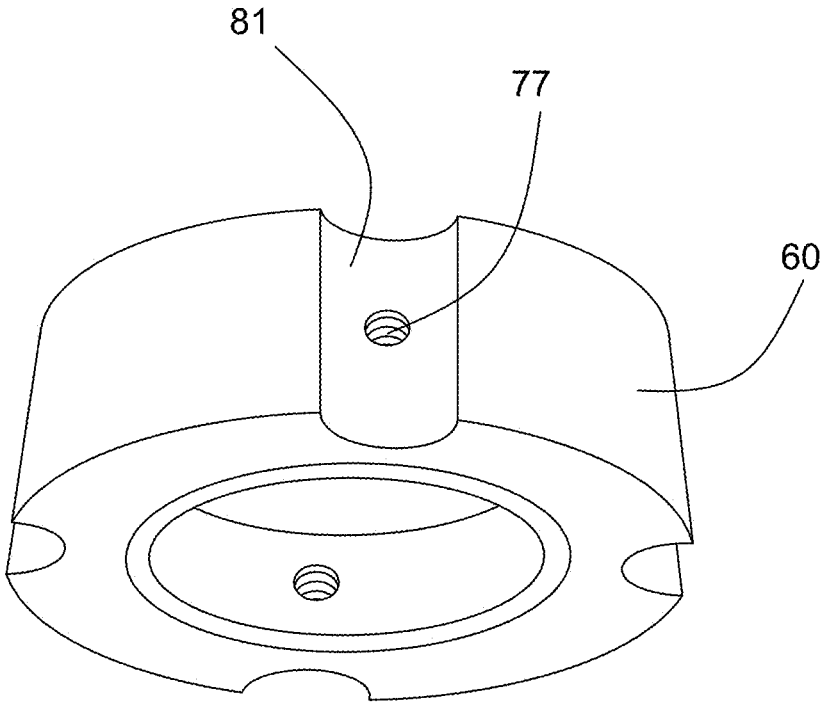
Figure 15:
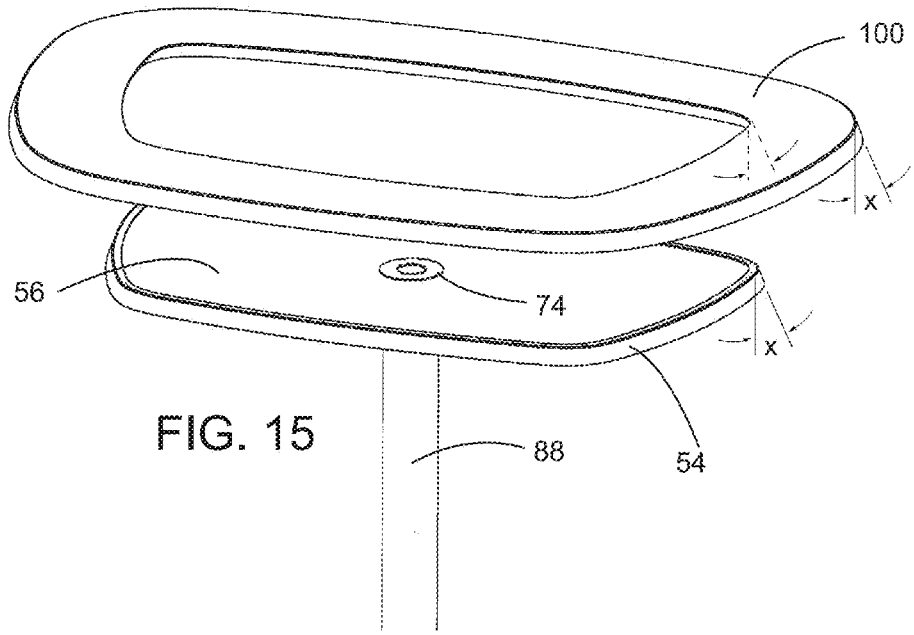
Figure 16:
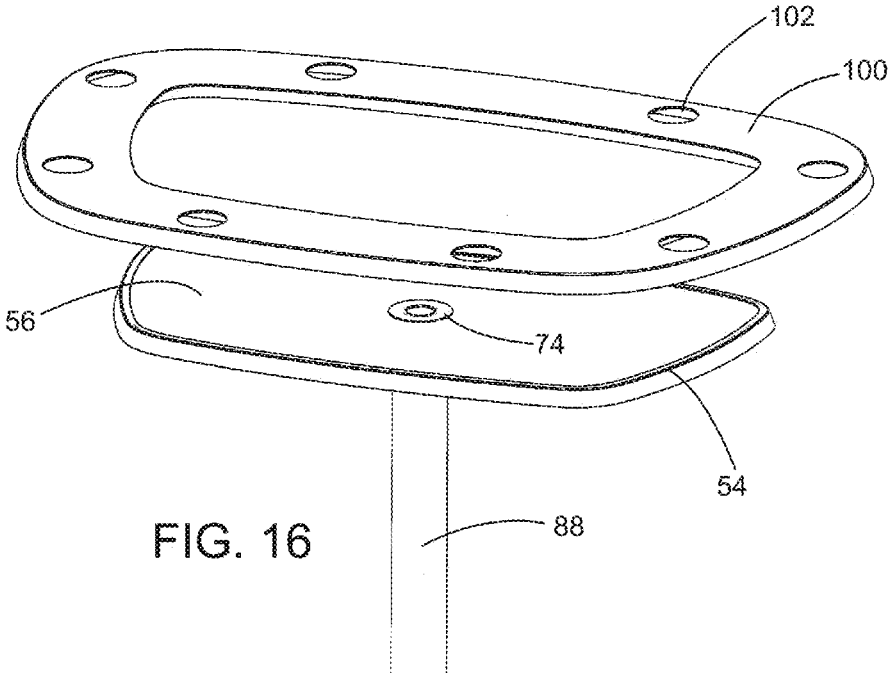
Figure 17:
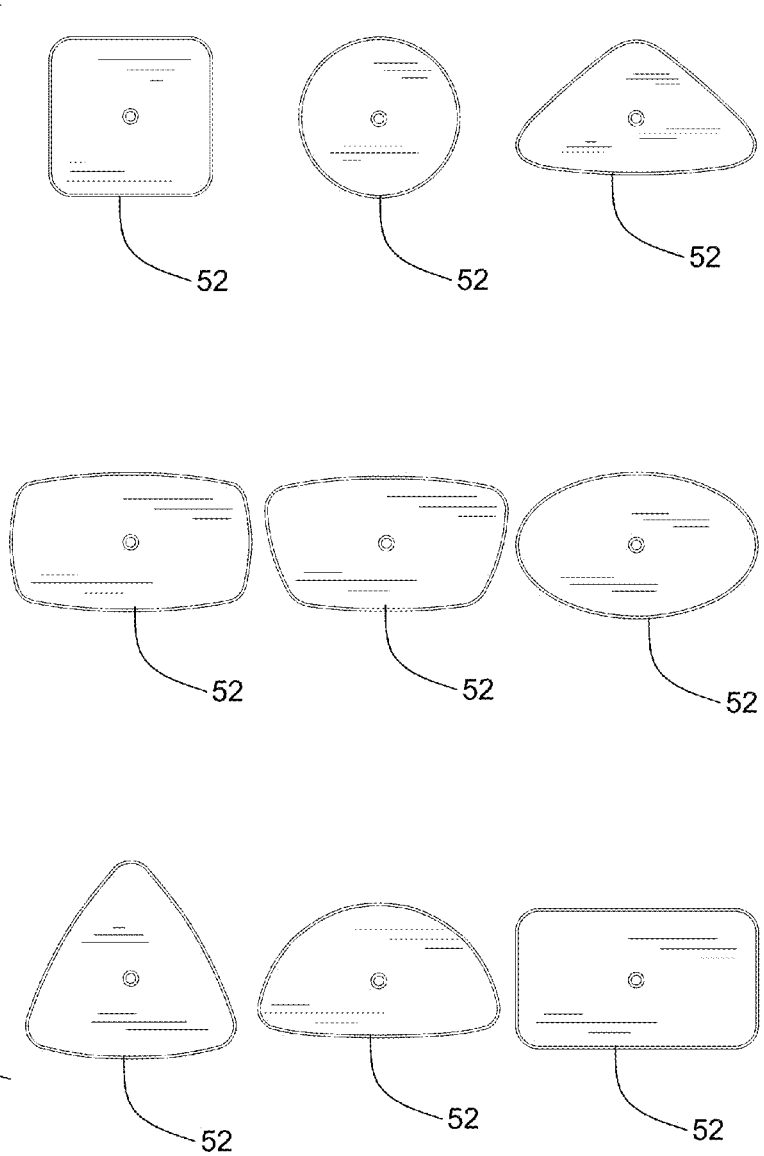
Figure 18:
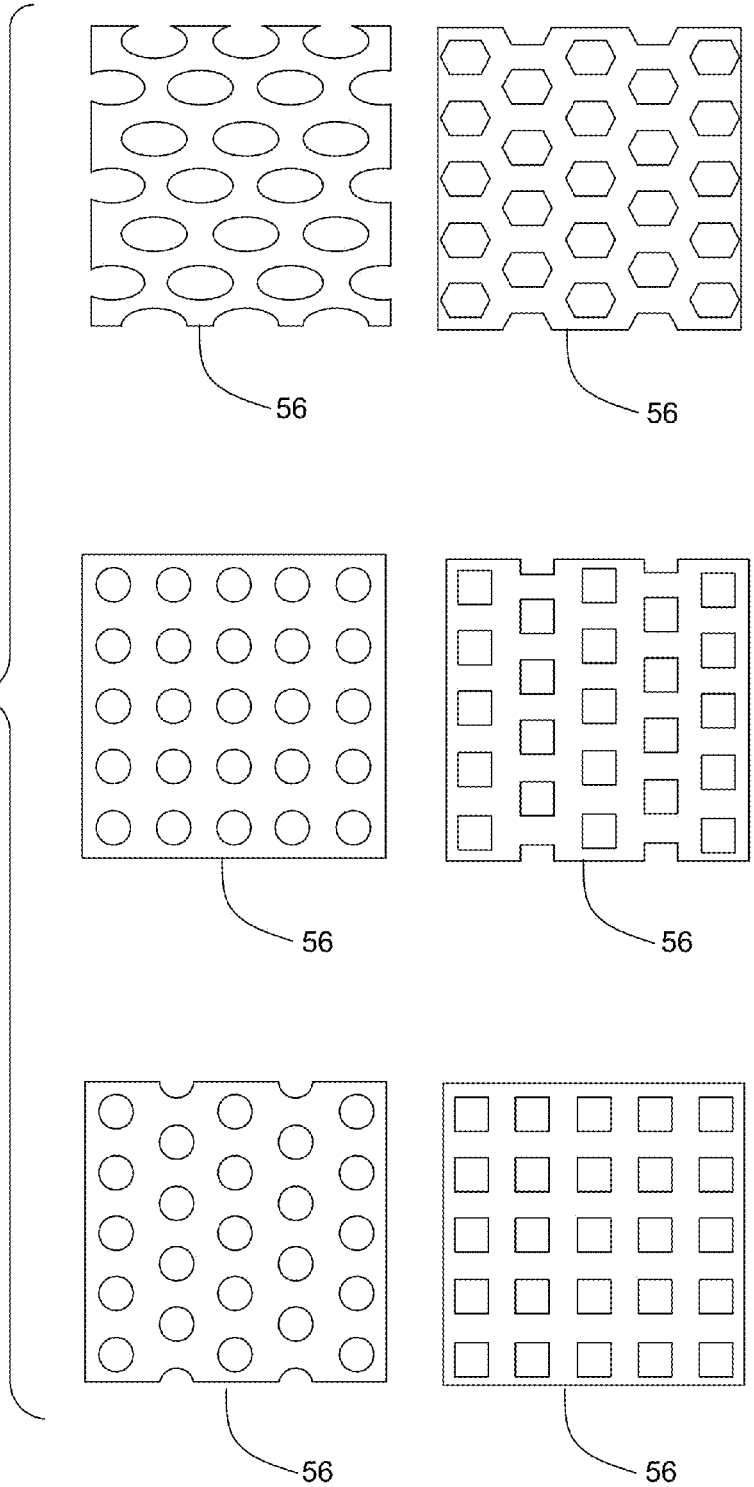
Figures 19, 20, 20A, 21, 22, 23:
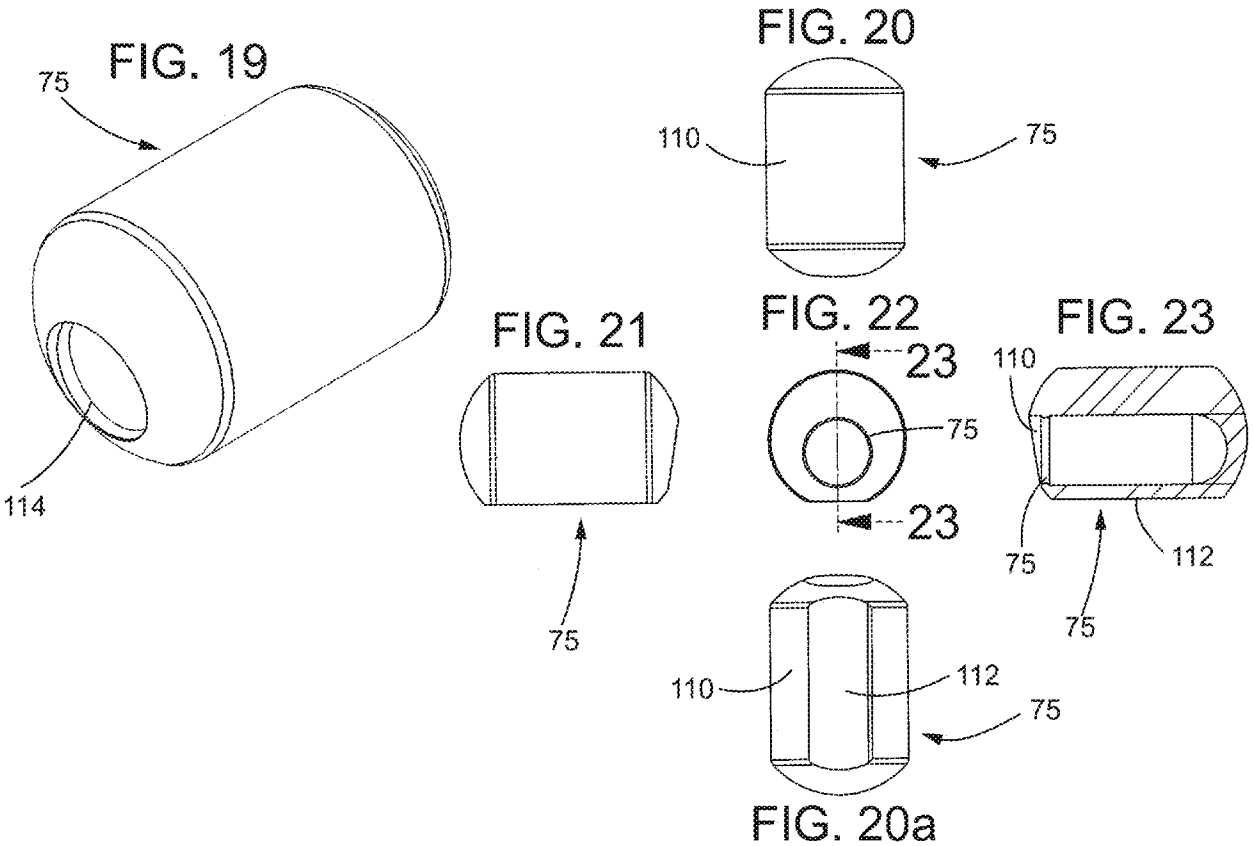
Figure 24:
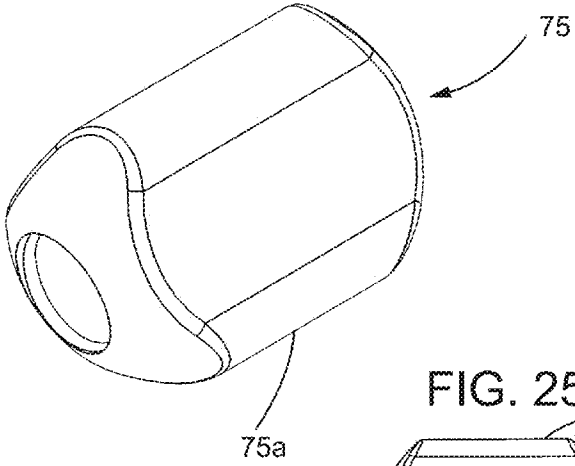
Figure 26:
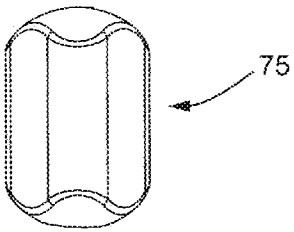
Figure 25:
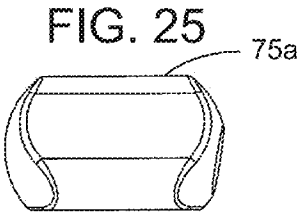
Figure 27:
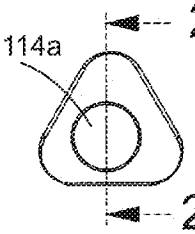
Figure 28:
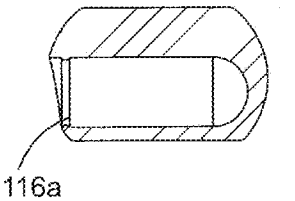
Figure 29:
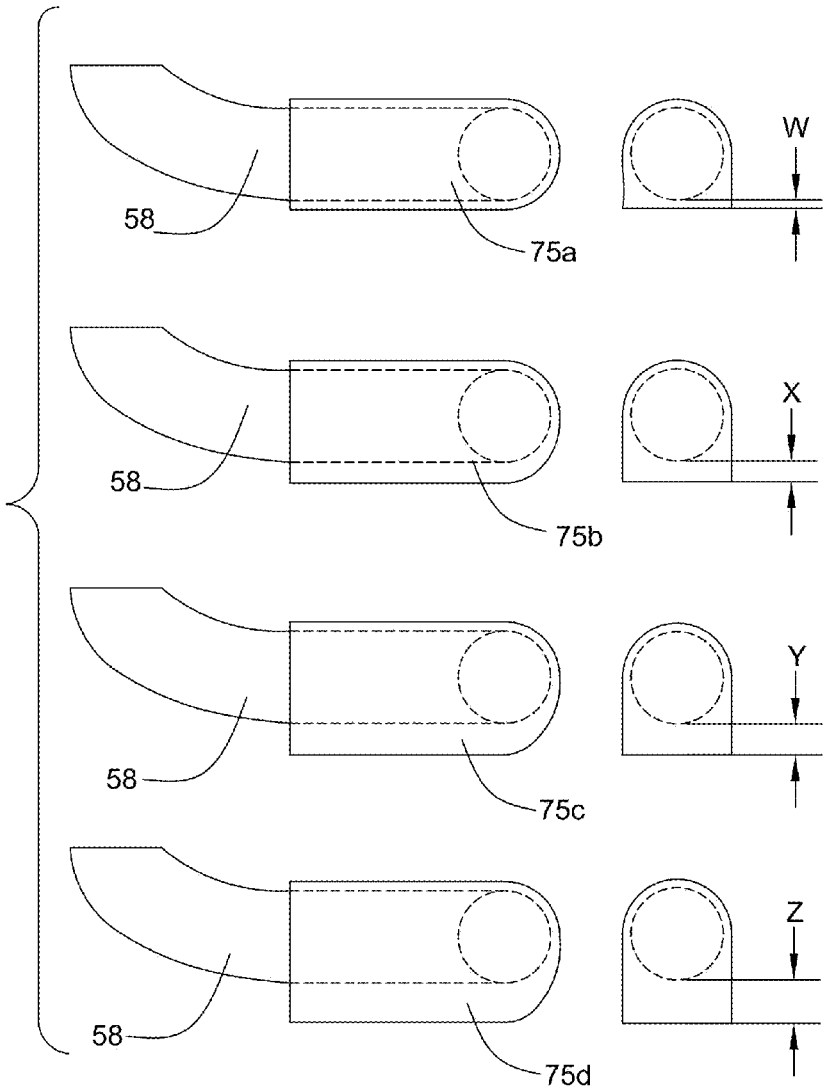
Figure 29A:
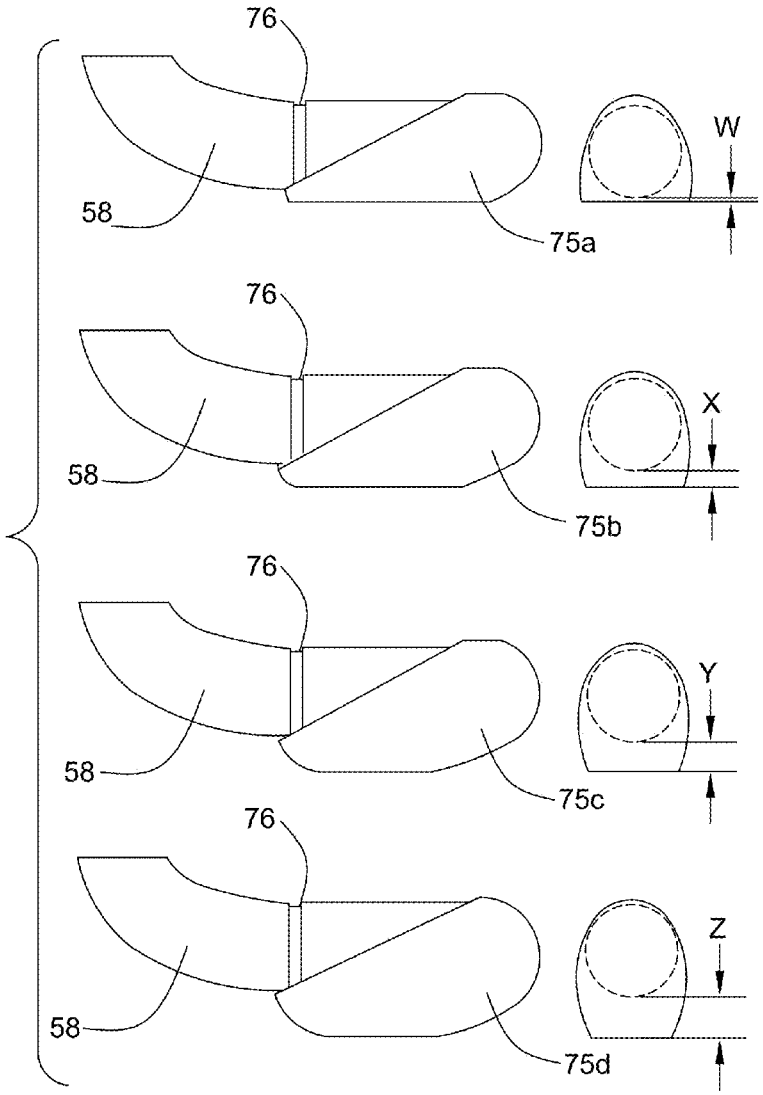
Figure 30:
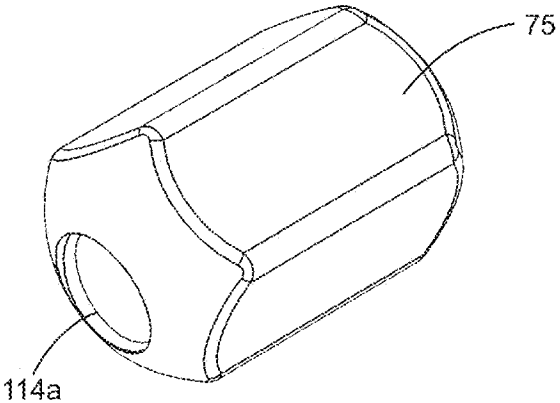
Figure 31:
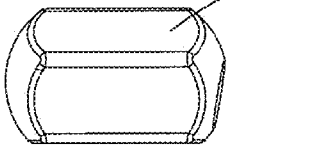
Figure 32:
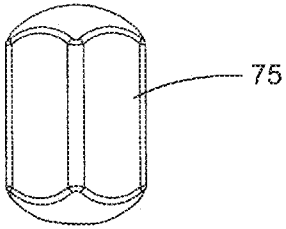
Figure 33:
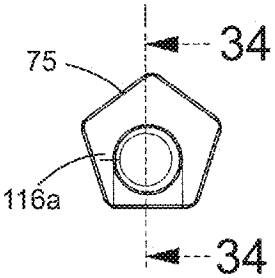
Figure 34:
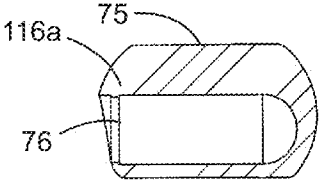
Figure 35:
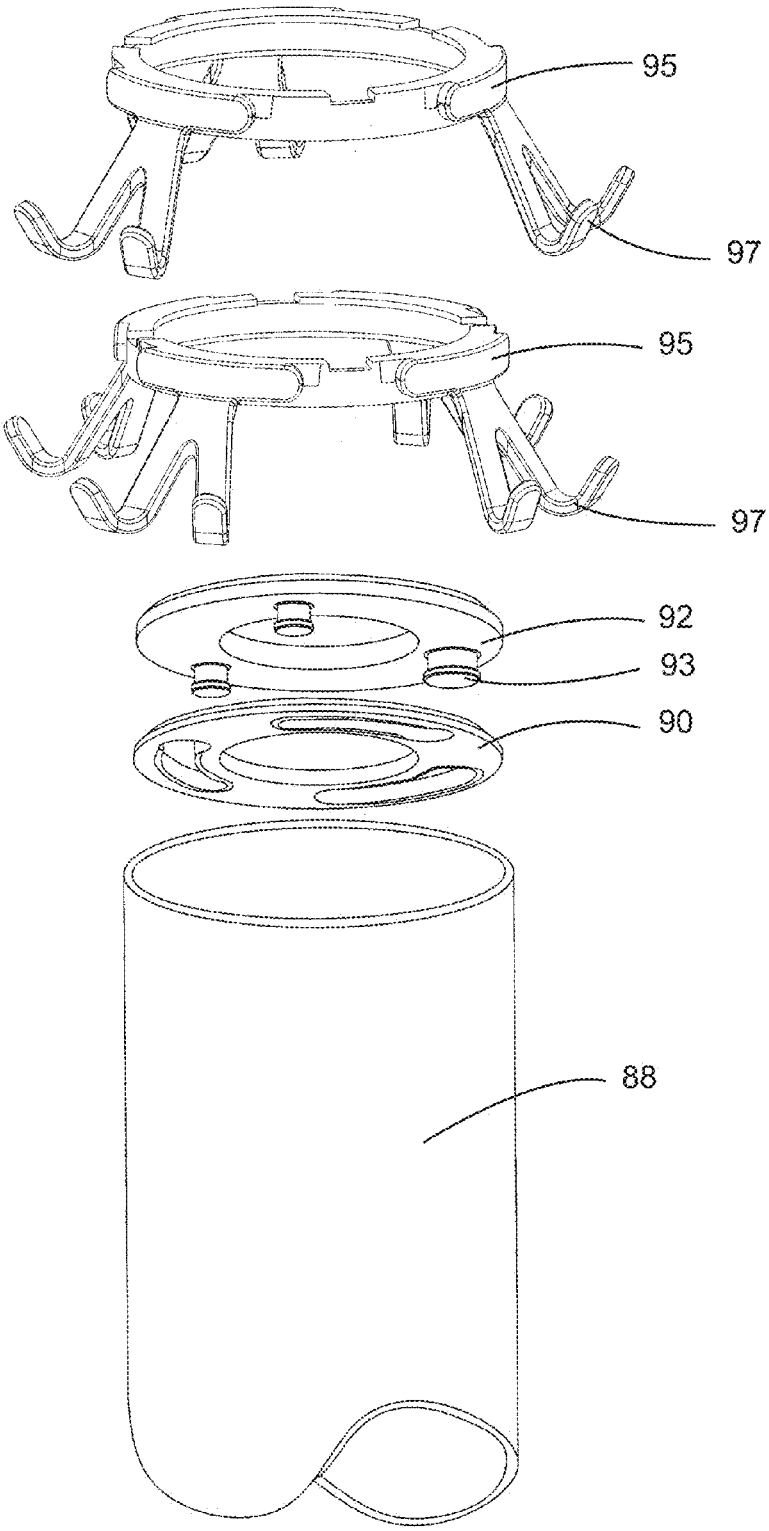
Figure 36:
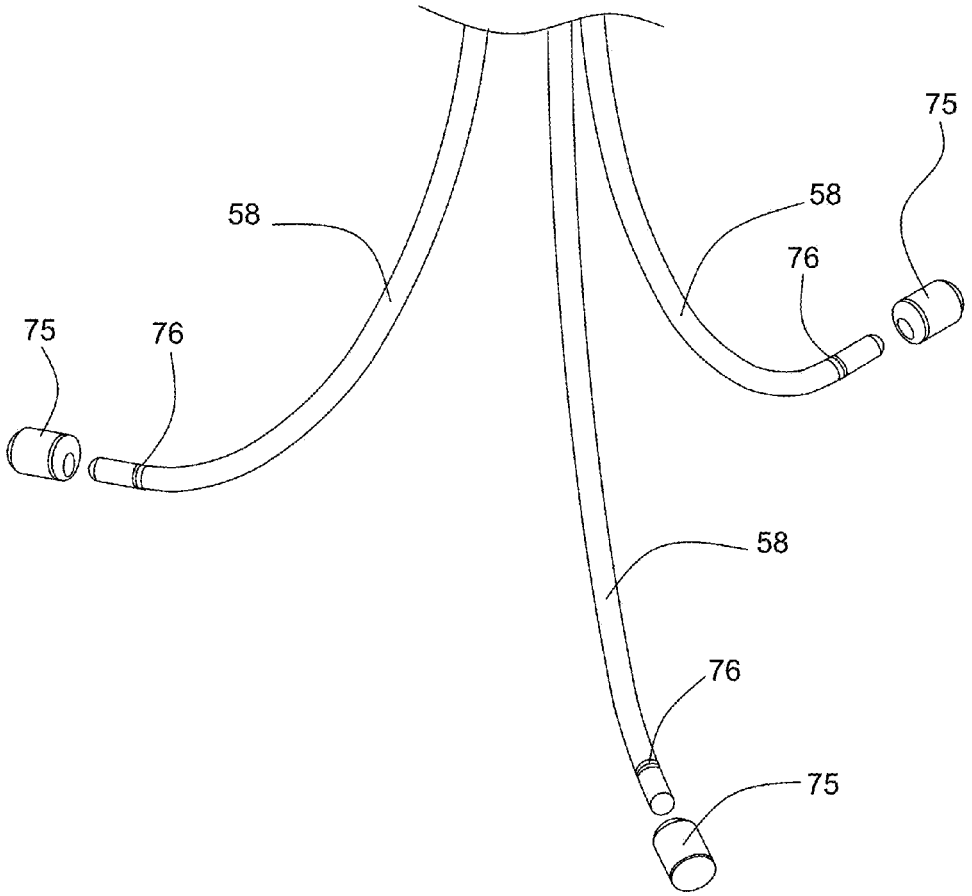

FIG. 10*a* is an exploded perspective view similar to FIG. 10, for a 4 leg table;

FIG. 11 is a partial exploded view of table top components and with a hook ring, a tubular leg and interlocking plates;

FIG. 11*a* is an exemplary exploded view of a top construction and an optional twist-on tubular leg employing interlocking plates;

FIG. 12 is an exploded perspective view of an exemplary cross bar construction for a 3 leg table and a leg hub;

FIG. 13 is an exploded perspective view of a cross bar top construction with the optional twist on tubular leg mounts and a pedestal base;

FIG. 14 is an exploded top perspective view of a pole cup and 3 leg hub;

FIG. 14*a* is an enlarged bottom perspective view of a 4 leg hub;

FIG. 15 is a top down perspective view of a table extender with an exemplary top;

FIG. 16 is another top down perspective view of a table top with an alternate top extender;

FIG. 17 is a composite plan view of an exemplary sample of selectable top shapes;

FIG. 18 is a composite plan view showing fragmentary samples of exemplary grid type tops for selection;

FIG. 19 is a front end perspective of a foot leveler component;

FIGS. 20 and 20*a* are plan views of the top and bottom respectively, of the leveler of FIG. 19;

FIG. 21 is a side plan view of the leveler of FIG. 20;

FIG. 22 is an end view of the leveler here being substantially round in shape with a flat bottom;

FIG. 23 is a cross sectional view along the line 23-23 in FIG. 22;

FIG. 24 is a perspective view of another foot leveler substantially triangular in shape;

FIG. 25 is a side plan view of the leveler of FIG. 24;

FIG. 26 is a top plan view of the leveler of FIG. 24;

FIG. 27 is yet another plan view of the leveler of FIG. 24;

FIG. 28 is a cross-sectional view along the line 28-28 of FIG. 27;

FIGS. 29 and 29*a* are composite views of alternative levelers in a set;

FIG. 30 is a perspective view of another foot leveler here being pentagon shaped FIG. 31 is a side plan view of the leveler of FIG. 29;

FIG. 32 is a side plan view of the leveler of FIG. 30;

FIG. 33 is a top plan view of the leveler of FIG. 30;

FIG. 34 is an end view of the leveler taken along the line 34-34 in FIG. 33;

FIG. 35 is an exploded perspective view of a hook rings and tubular leg;

FIG. 36 is a partial perspective view of exemplary legs with levelers exploded therefrom.

Figure 37:
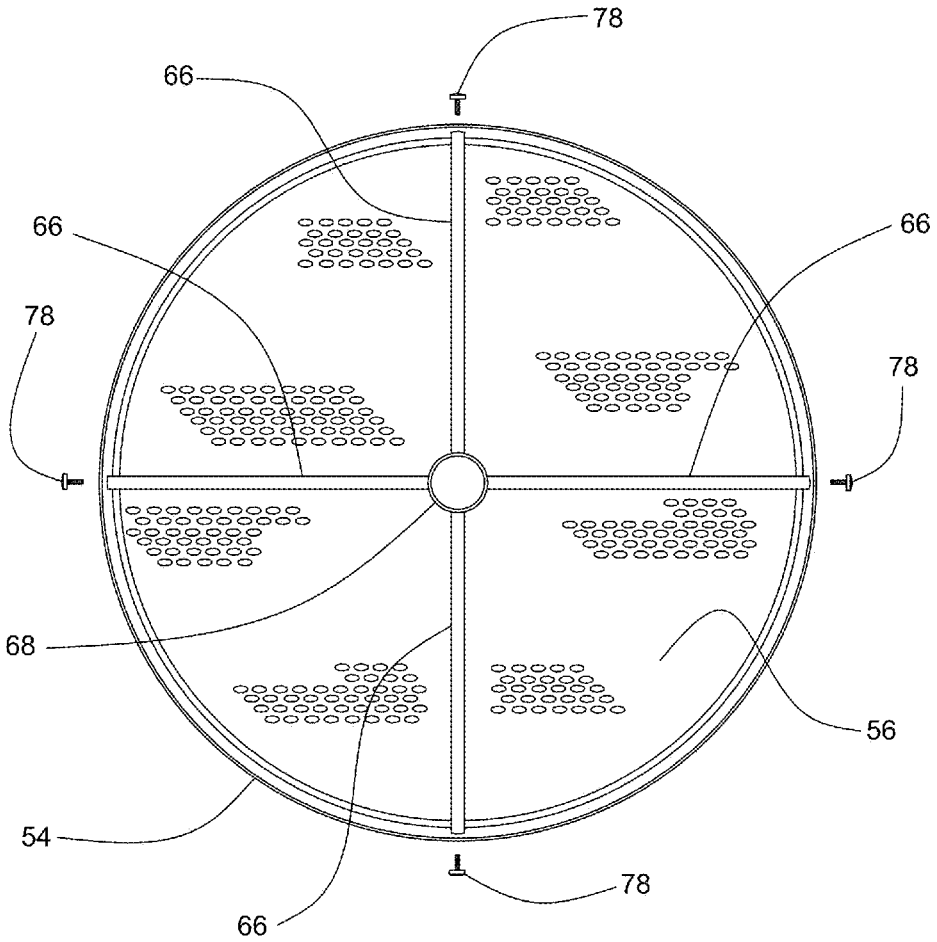
Figure 38:
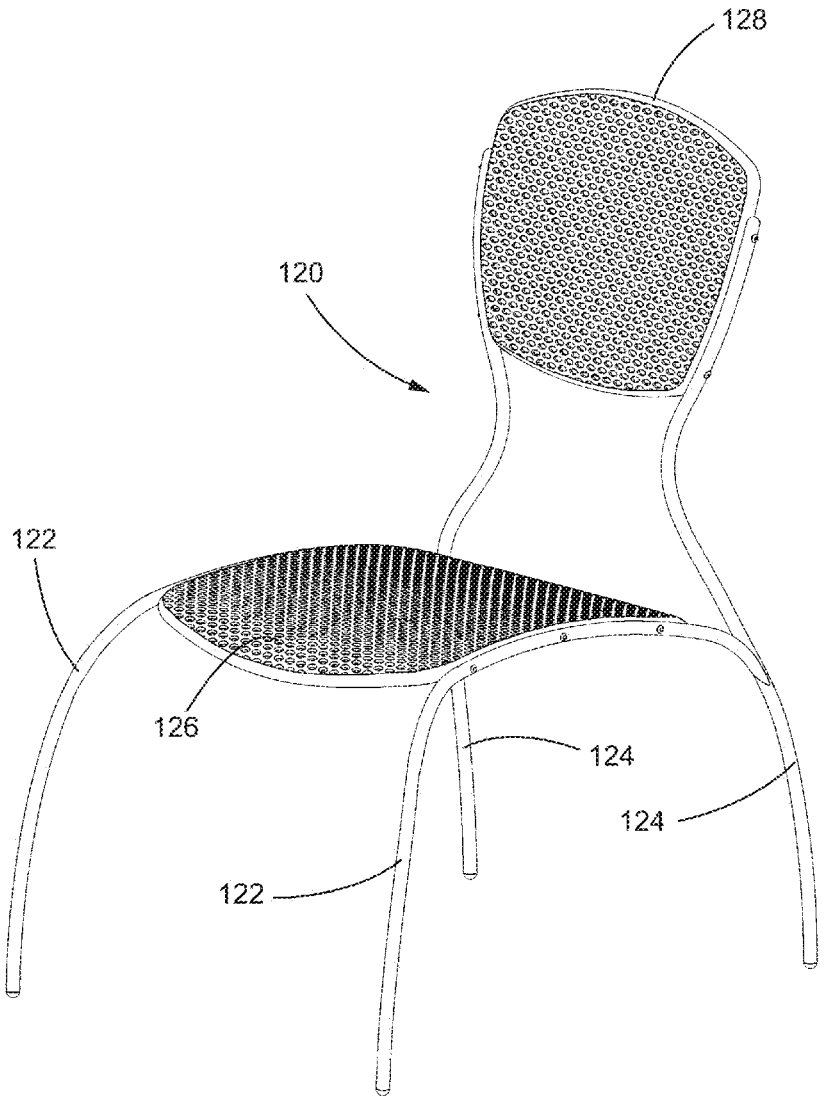
Figure 39:
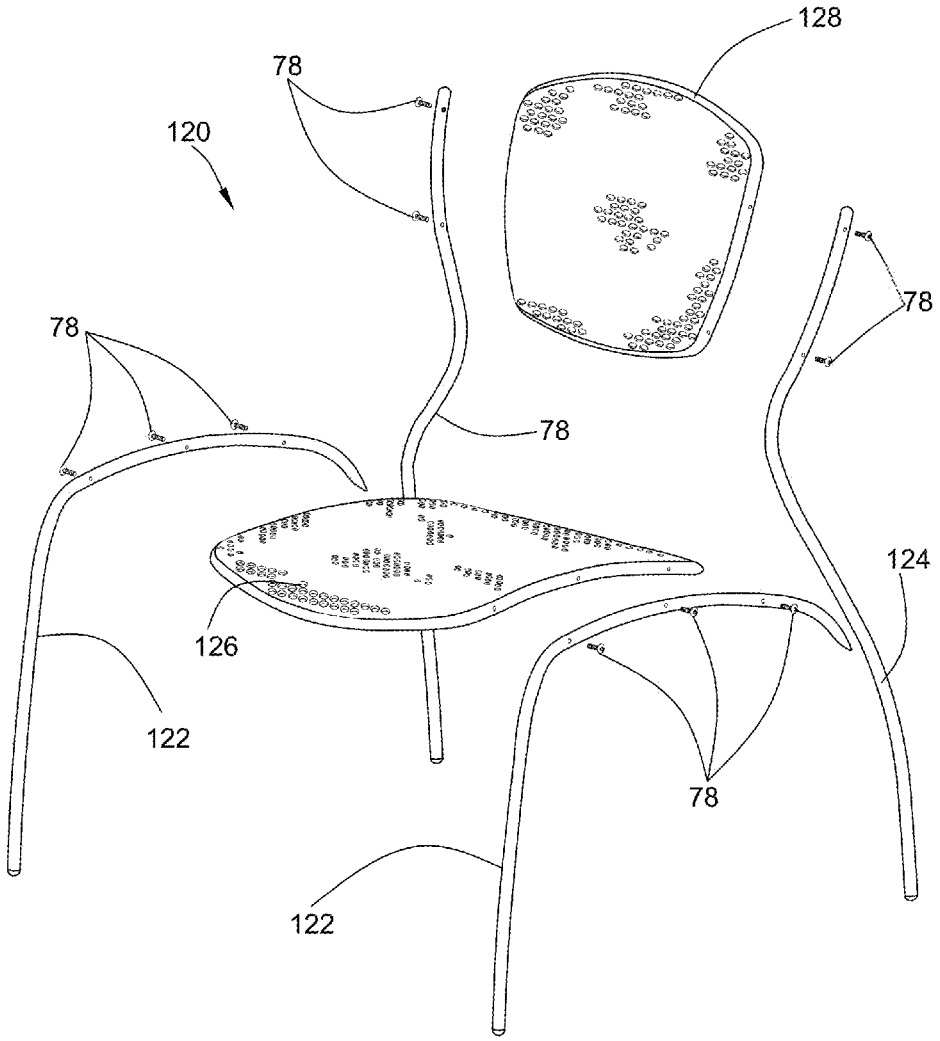
Figure 40:
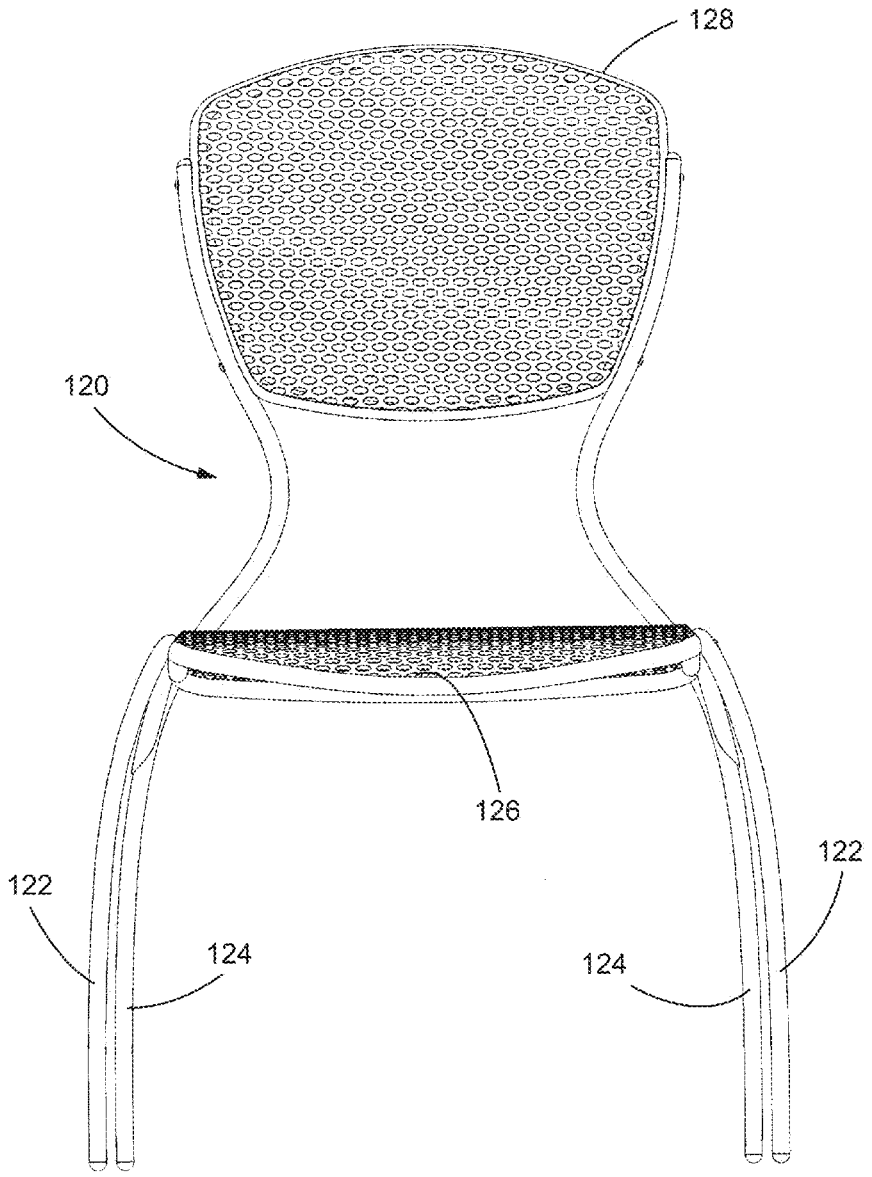
Figure 41:
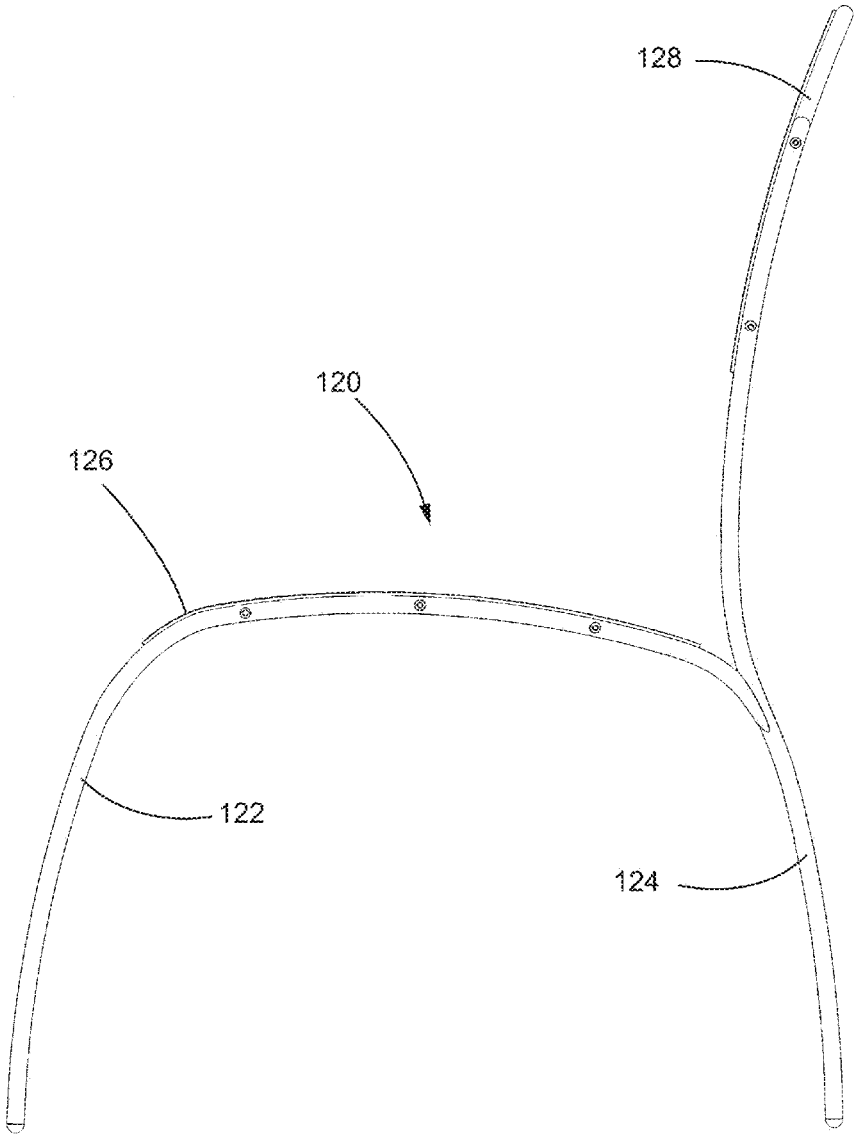
Figure 42:
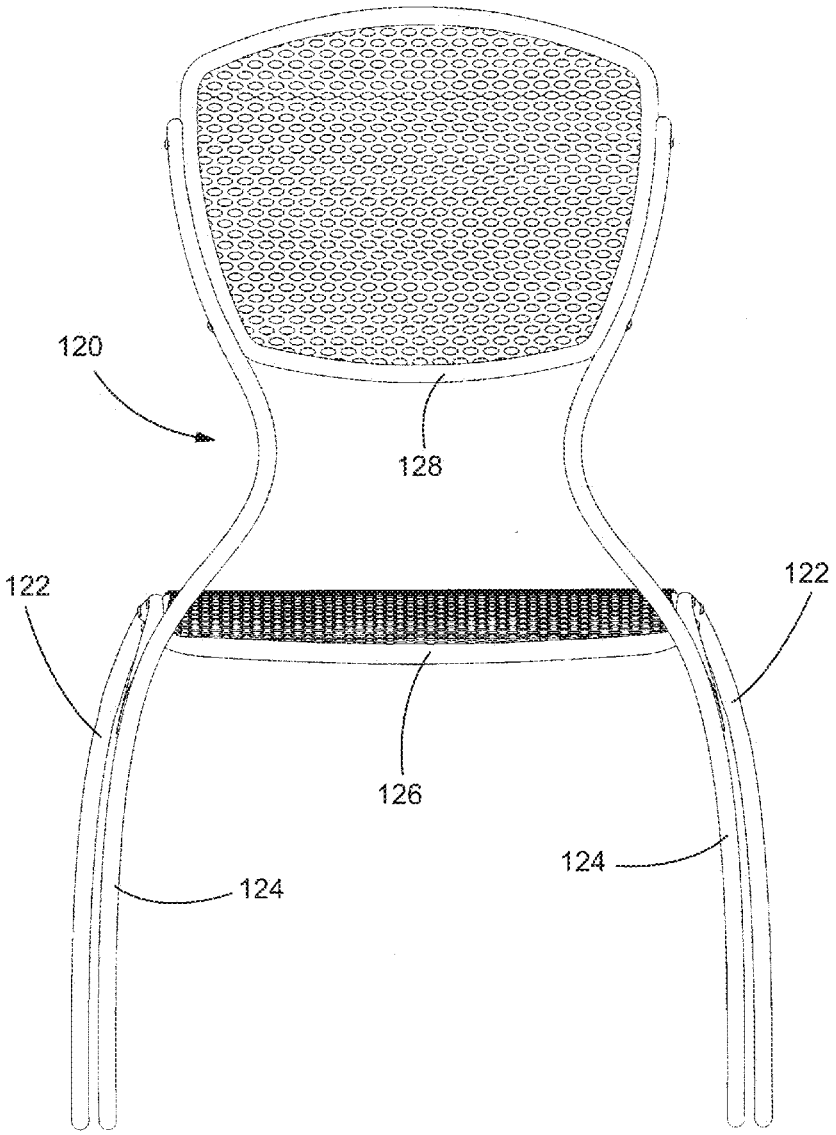
Figure 43:
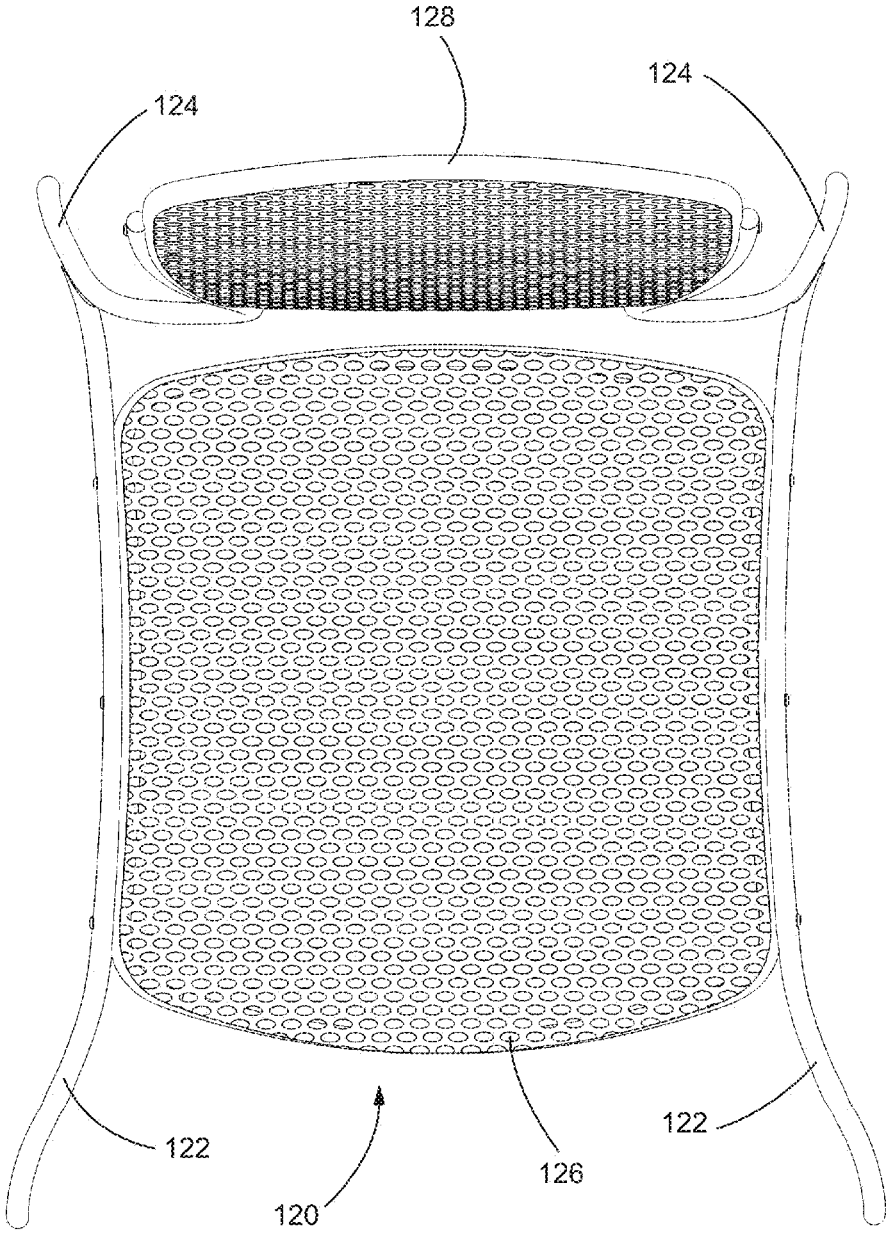
Figure 44:
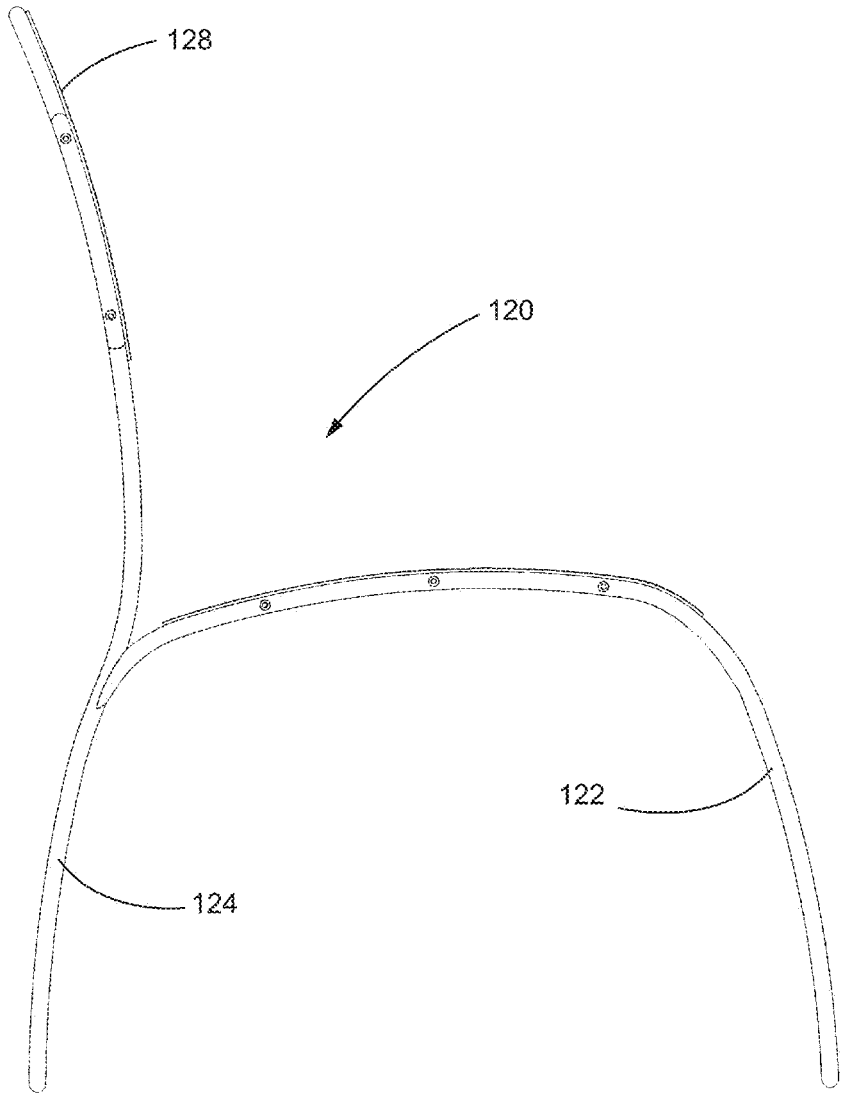
Figure 45:
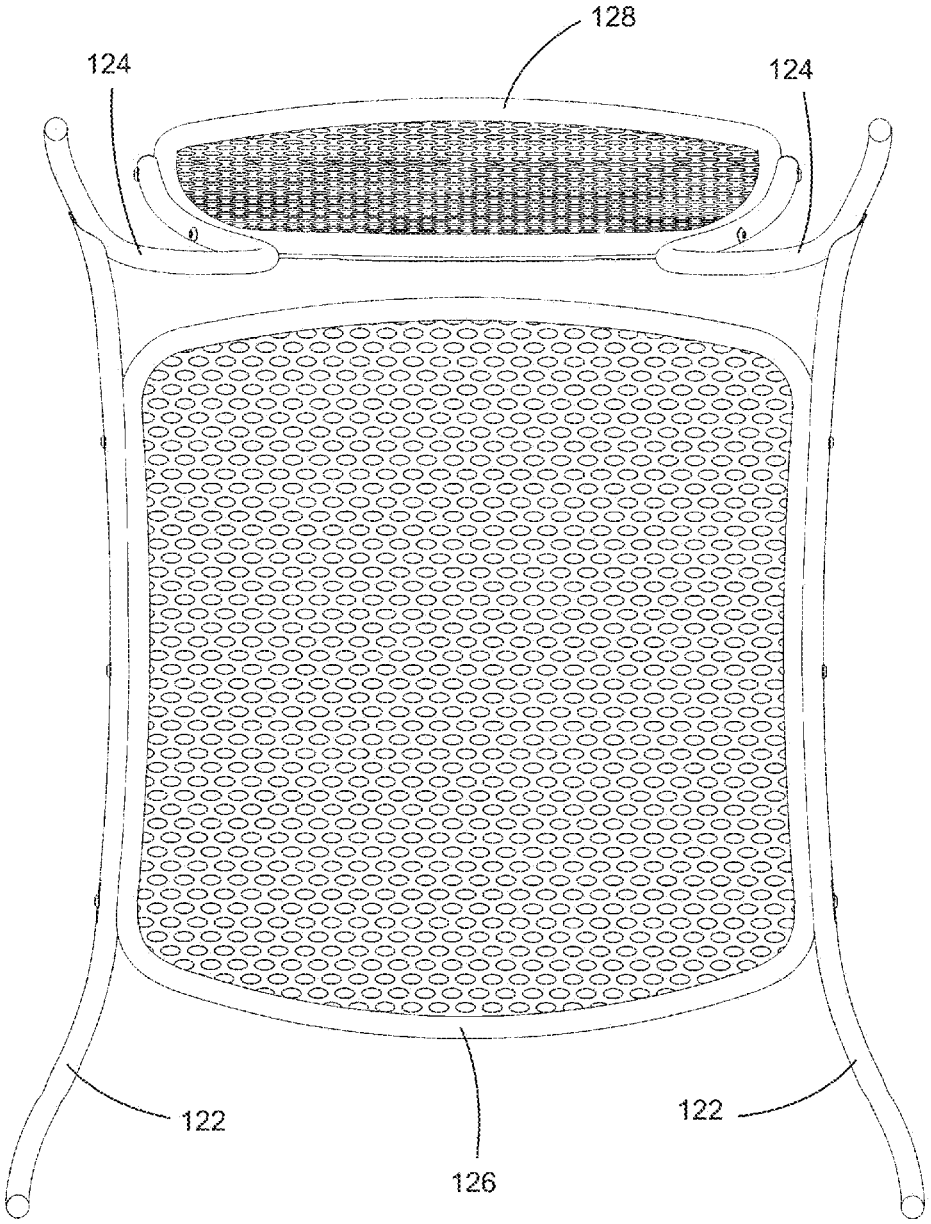
Figure 46:
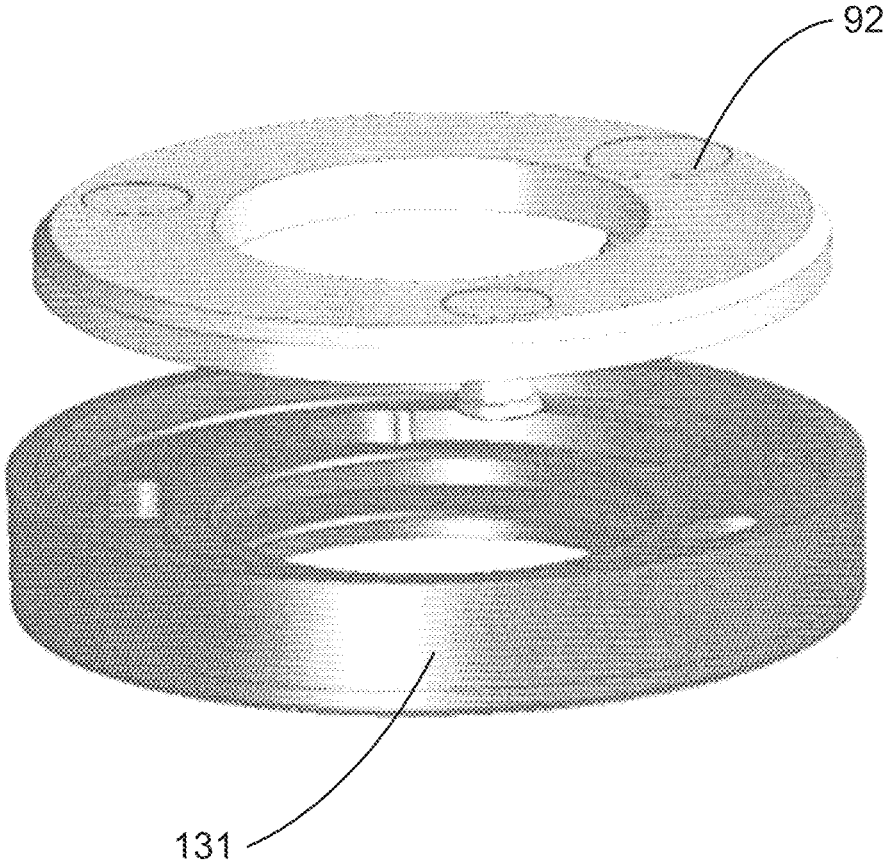
Figure 47:
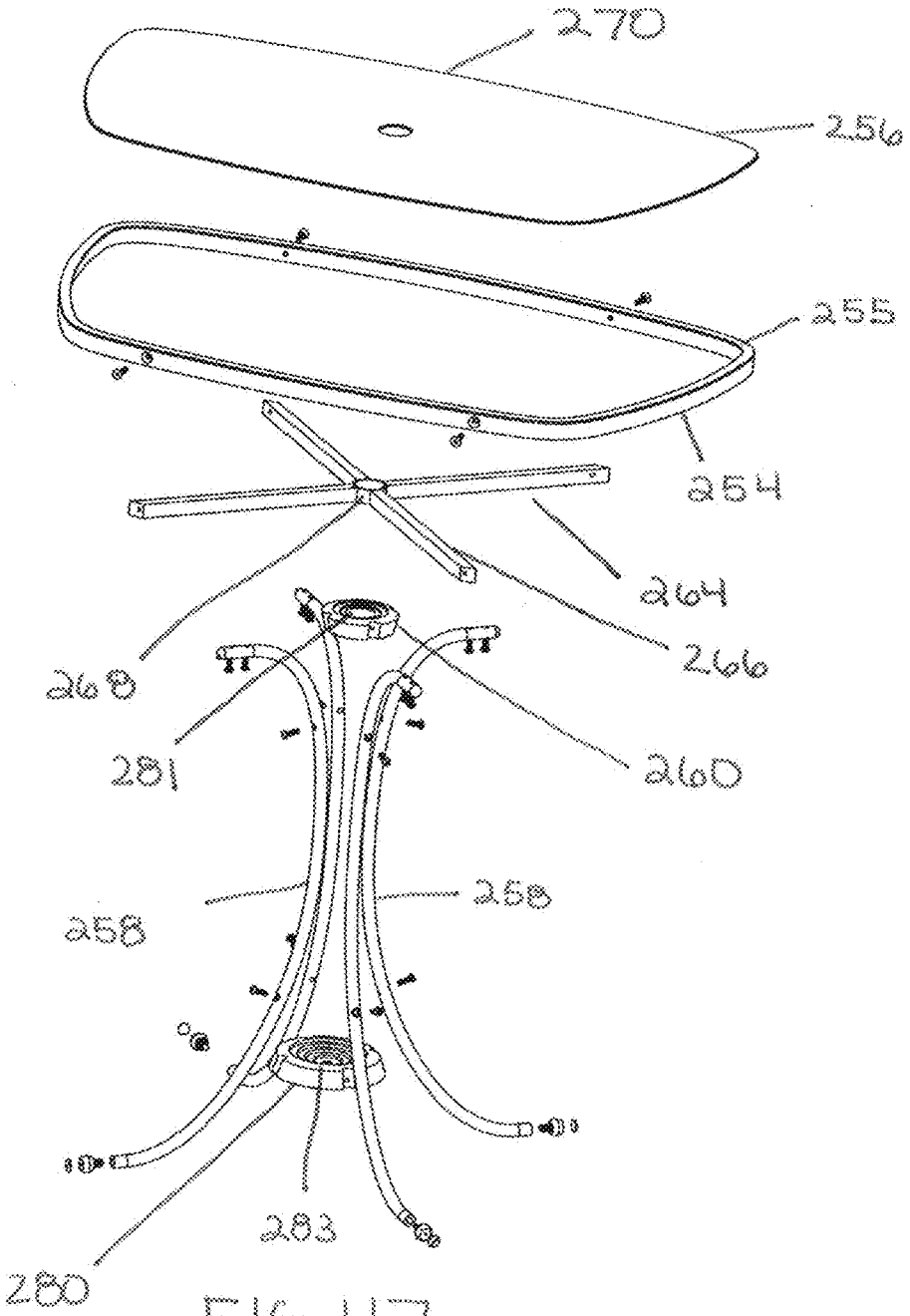
Figure 48A:
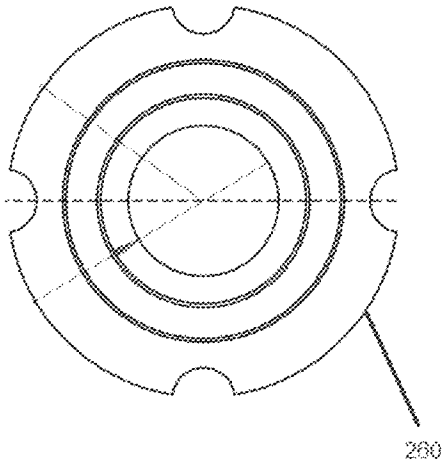
Figure 48B:
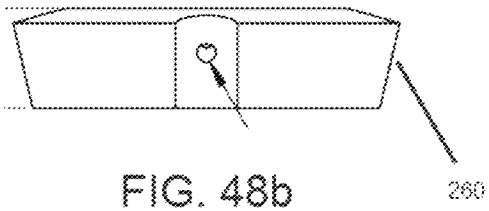
Figure 48:
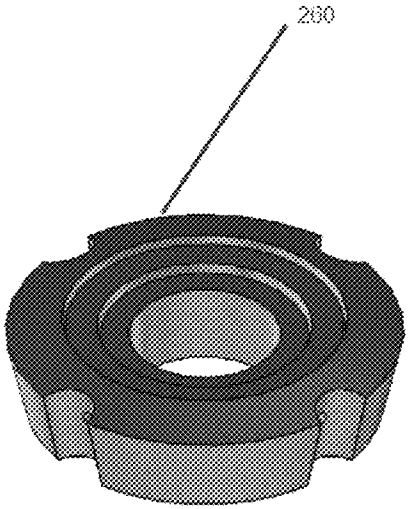
Figure 49A:
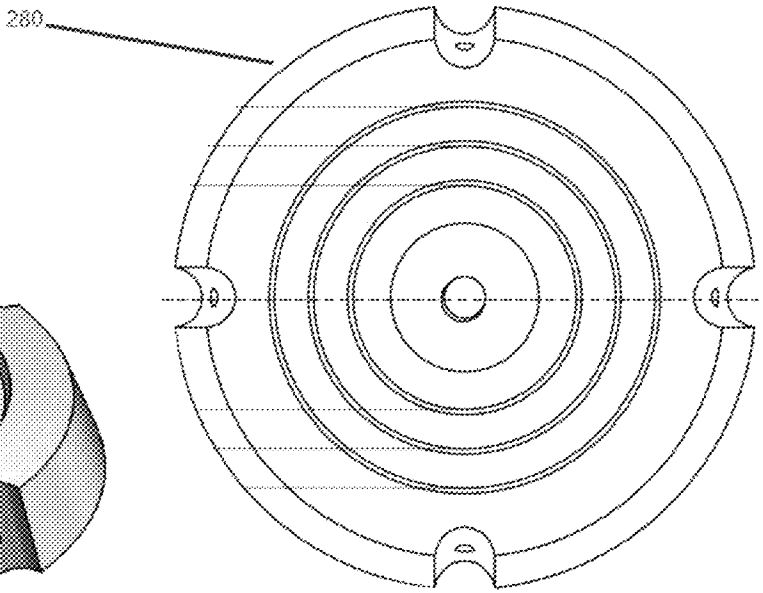
Figure 49B:
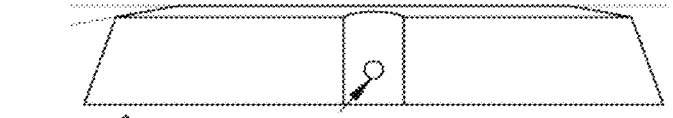
Figure 49:
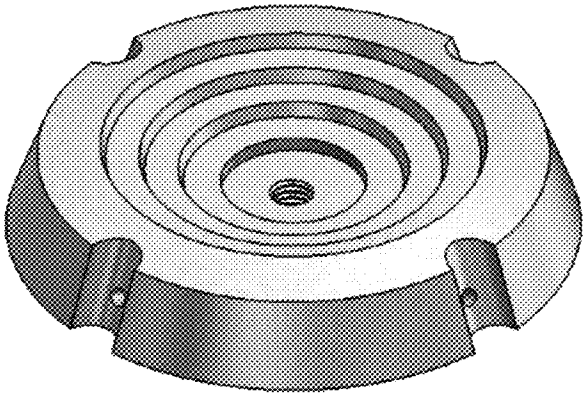
Figure 50:
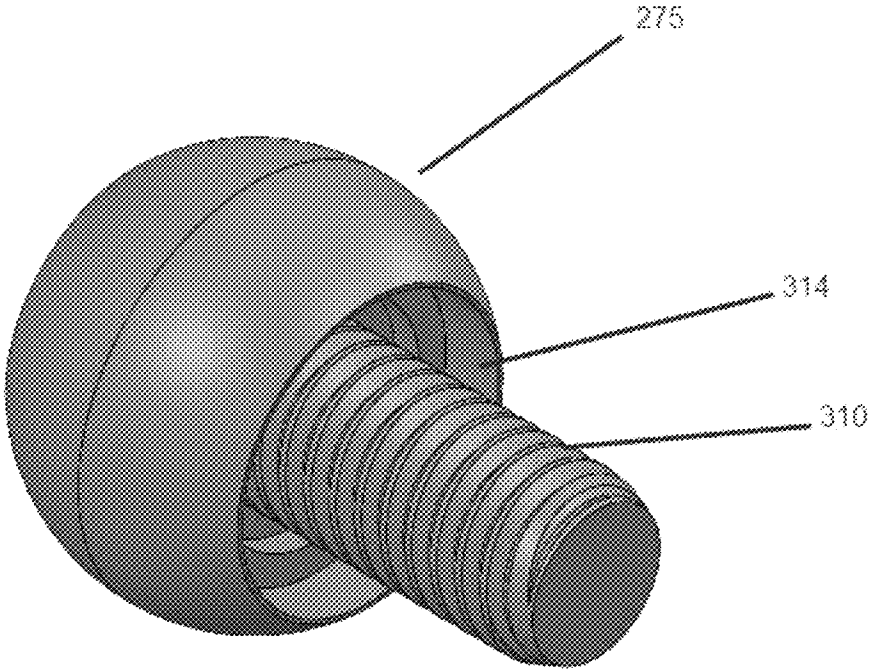
Figure 51B:
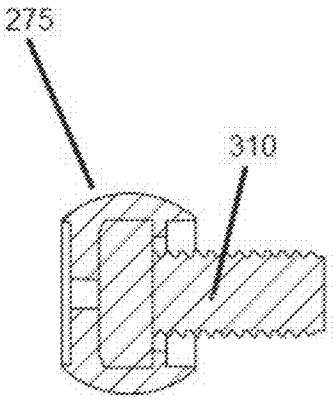
Figure 51A:
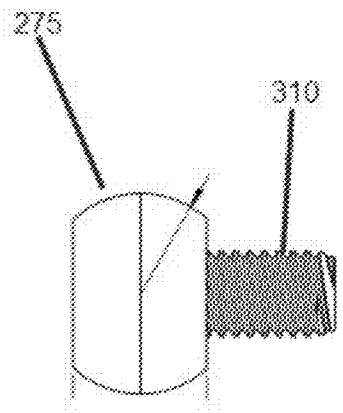
Figure 51:
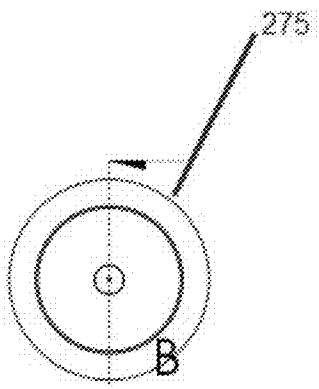

FIG. 37 is a bottom plan view of an exemplary table construction here showing a removable assembly;

FIG. 38 is a perspective view of a complementary chair;

FIG. 39 is an exploded perspective view of the chair of FIG. 38;

FIG. 40 is a front elevational view thereof;

FIG. 41 is a right side elevational view thereof;

FIG. 42 is a rear side elevational view thereof;

FIG. 43 is a top plan view thereof;

FIG. 44 is a left side elevational view thereof;

FIG. 45 is a bottom plan view thereof;

FIG. 46 is a perspective view of a protective cover for the interlocking plate with lugs;

FIG. 47 is an exploded view of an alternative embodiment of a 4 leg table;

FIGS. 48, 48*a*, and 48*b* are a perspective view, a top view, and a side view of the smaller top hub for a 4 leg table;

FIGS. 49, 49*a*, and 49*b* are a perspective view, a top view, and a side view of the larger bottom hub for a 4 leg table;

FIG. 50 is a back end perspective view of another embodiment of a foot leveler component here being bulb shaped; and FIGS. 51, 51*a*, and 51*b* are plan views of the end, side, and cross sectional views respectively, of the leveler in FIG. 50.

DETAILED DESCRIPTION OF THE INVENTION

Referring to the drawings, particularly FIGS. 1-9, conjointly, there is shown an exemplary table line construction embodied in the present invention and generally indicated at 50. As shown, each table 50 includes a top 52 with a peripheral frame 54, a top surface 56, here being a grid, 3 or 4 leg members 58, here being curved tubular or rod-like, and a hub 60 intermediate leg ends for fastening the legs together. As illustrated the tables include an opening 62 for an umbrella pole 63 or the like.

In accordance with the present invention, the tables are representative of a furniture line customizable with the table being ideally suited for use on small balconies, terraces, decks or walkways which are confined or have irregular shaped areas. The customization of the tables is implemented by the provision of selectable numbers of a variety of geometric shape frames, corresponding tops, selectable from numerous materials and patterns in solid surface or grids and other options like openings for umbrella or light poles, holders, leg numbers and type, foot levelers and hooks.

Referring to FIG. 10, the exploded view of components for an exemplary 3 leg table 50 includes a peripheral frame 54 which has an inwardly extending lip 55 on the top edge of the frame wall. The wall is preferably angled with the angle being approximately between 65° and 110° and the optimal angle is about 70°. A top 56 complementary with the frame shape fits into the frame held against the lip 55. Beneath the top 56 there is provided a cross bar member 64 having arms 66 and a ring 68 forming a spoke-like construction when assembled. The outer arm 66 ends attach to the inner wall of frame 54 to form the top assembly. In this instance the top is provided with an opening 70 for receipt of an umbrella pole 72. The top opening 70 corresponds to the center ring 68 of the pole member in location which would be the epicenter of the particular shaped table top. A top ring 74 finishes the top. The table legs 58 are vertical intermediate the ends and from the vertical position they curve outwardly and become horizontal at the top and bottom ends.

The bottom horizontal leg portions are provided with a threaded interior inward of the end tip to receive and hold a rotatable foot leveler 75 such as shown in FIGS. 19 to 24 and FIG. 36.

In order to secure the legs together there is provided a hub 60 which is collar shaped and has vertical semicircular grooves 81 symmetrically spaced about its outer periphery. The legs 58 attach to the collar or hub 60 that has tapped holes 77 (shown in FIG. 14*a*) by way of Allen Head machine screws 78.

In accordance with the invention, referring to FIGS. 10 and 10*a*, the components which make up the table assembly are fairly few in number and capable of being "bin" or inventory parts. This hub 60 available for 3 or 4 leg versions can be stocked for purchase selection. Likewise center tube 68, ring 74, and legs 56 in a number of sizes may be stocked. The top frames, tops, and cross-bars are also possible stockable parts according to the number of selectable tables being offered. The accents and other accessories may be further stocked items.

In FIGS. 10 and 10*a* there is shown a partial portion of a pole 63 such as for an umbrella (not shown) that passes through the table opening 60 and the collar hub 60. A stop ring embedded in bottom hub 60*a* can be used to limit the height of the pole from the ground.

Alternatively, referring to FIGS. 12 and 14, a cup member 82 having cylindrical bottom portion 83 and an enlarged rim 84 seats in a groove 85 on collar hub 60 to receive the end of a pole 63.

An alternative embodiment of a table is illustrated in FIG. 47. An exploded view of components for an exemplary 4 leg table 250 includes a peripheral frame 254 which has an inwardly extending lip 255 on the top edge of the frame wall. A top 256 complementary with the frame shape fits into the frame held against the lip 255. Beneath the top 256 there is provided a cross bar member 264 having arms 266 and a ring 268 forming a spoke-like construction when assembled. In some embodiments the top is provided with an opening 270 for receipt of an umbrella pole. The table legs 258 are vertical intermediate the ends and from the vertical position they curve outwardly and become horizontal at the top and bottom ends. In order to secure the legs together there is provided an upper hub 260 and a lower hub 280. The hubs are collar shaped and have vertical semicircular grooves 281 and 283 symmetrically spaced about their outer periphery. The legs 258 attach to the collars or hubs 260 and 280 that have tapped holes by way of Allen Head machine screws The upper hub 260 described above is illustrated in greater detail in FIGS. 48, 48*a*, and 48*b*. The embedded upper hub 260 can receive a pole end.

The lower hub 280 described above is illustrated in greater detail in FIGS. 49, 49*a*, and 49*b*. The embedded lower hub 280 can receive a pole end.

Referring to FIGS. 11, 11*a* and 13, a tubular leg 88 is provided that is attached with interlocking plates or rings 90, 92. The upper ring 92 here shown with lugs 93 attaches to the cross bar structure and the lower ring with slots 94 is affixed to the tubular leg 88 top. Of course, the rings can be reversed and in either case the tube would be attachable and removable with a twisting movement. The lower end of tubular leg 88 attaches to a base 99 which can be round or other shapes. The preferred attachment is by way of similar interlocking plates or rings 90, 92*a* allowing for a twist connection. The pedestal base 99 is here shown as circular, however, it is intended that a number of different geometric shaped bases will be provided for selection.

Another accessory shown in FIGS. 11 and 35 is a hook member 95 which is a ring 96 and a series of single hooks 97 that seats above the tubular leg 88. Referring to FIG. 35 there is shown a double hook 95 alternative. The hooks can be used to hang articles beneath the table top.

In accordance with another aspect of the invention the table tops may be enlarged when larger surfaces are needed. Referring to FIGS. 15 and 16, there is shown examples of extenders 100 that fit around the table top 56 providing additional top surface. The extenders are collar like with an interior opening the edge of which is angled to be complementary to the angle of outer edge 54 of the top 56. It is preferred that the angle is approximately 70°.

In FIG. 15 the top extender 100 is a flat surface while in FIG. 16 the extender is provided with cup holder openings 102.

As shown in FIG. 17, an exemplary number of different geometric shaped tops 52 are provided for selection. Each of the shapes can be provided in a selectable number of dimensions. FIG. 18 shows an exemplary number of grid 56 designs that can be provided for selection. The selectable tops can also include solid surfaces made of different materials and with choices of colors and surface designs.

In accordance with another aspect of the invention, foot levelers 75 are provided that are either stationary or rotatable to provide stability on uneven surfaces.

Referring to FIGS. 19-28, the foot leveler 75 is an elongated body 110 substantially cylindrical with a flat portion 112. An elongated opening 114 eccentrically located allows the leveler to slide onto the horizontal ends of the table legs. An internal rib 116 snap fits with the annular groove 76 of the table legs.

In FIG. 24-28 the foot leveler is substantially triangular in cross-section and the center opening is eccentrically located so that when rotated there are three different radii to make leveling adjustments.

Another embodiment of a foot leveler is illustrated in FIGS. 49-52. The foot leveler 275 is bulb shaped and has an elongated body 310 that is substantially cylindrical. In some embodiments, the elongated body may have a flat portion. An elongated opening 314 eccentrically located allows the leveler to screw into the horizontal ends of table leg.

In FIGS. 29 and 29*a* there are shown composite sets of slide on foot levelers which have different amounts of lift to level or stabilize a table leg.

FIGS. 30 to 34 show a substantially 5-sided or pentagon shaped in cross section leveler which upon rotation provides 5 different lift radii for leveling a table.

It will be appreciated that other polygonal cross-sectional shapes can be used to provide more or less amounts of lift.

Referring to FIG. 35 there is shown a partial view of a tubular leg 88 which can twist connect to an upper plate 90 (not shown) attached to the table top. Exploded above the leg is shown alternative hook rings 95 with double hooks 101 and with alternative 3 or 4 sets being shown.

Referring to FIG. 37, there is shown an exemplary underside of a table top where assembly of the frame 50, cross bar 66, sleeve 68 and top 56 are done with Allen head screws 78. This allows the top to be easily disassembled to replace or change a top surface.

In accordance with carrying out the method of the present invention there is shown in FIGS. 38-45 an illustrative complementary chair 120 that is customizable along with a table to make an ensemble.

The chair has tubular or rod-like front legs 122 and back legs 124. The front legs are bent over rearwardly and provide connection to a seat 126 by way of Allen head screws 78.

The seat 126 includes a tubular frame and top which can be a solid surface or a grid to match a table top in material and, if desired, substantially in shape.

The rear legs 124 rise up and support a seat back 128 also constructed with a frame and a top like the seat.

The front legs 122 are attached to the back legs 124 by way of Allen head screws. Referring to FIG. 46, there is shown a perspective view of a plastic protective cover 130 for the lugs of ring or plate 90 whether on the table or a base.

It will be appreciated that the foregoing description provides examples of the disclosed customizable table and furniture line. However, it is contemplated that other implementations of the disclosure may differ in detail from the foregoing examples. All references to the disclosures or examples thereof are intended to reference the particular example being discussed at that point and are not intended to imply any limitation as to the scope of the disclosures more generally. All language of distinction with respect to certain features is not intended to indicate a lack of preference for those features or to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods for selection or assembly described herein can be performed in any suitable order unless otherwise indicated herein as otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

The designs, shapes, sizes and arrangements shown and described are intended to be illustrative of the versatility and choices that would be available, however, it is not intended that other variations thereof are excluded.

I claim:

1. A method of providing purchaser customizable articles of furniture comprising: providing a number of skeletal frames for table tops of varying shapes and sizes for selection by purchaser; providing a selectable number of complementary insertable table tops, including grids and solid surfaces, receivable within the skeletal frames; providing a set of 3 or 4 tubular or rod-shaped legs attachable to the skeletal frames; providing at least one hub adapted to connect the legs together intermediate the leg ends; and providing means for fastening the legs to the hub and fastening the upper ends of the legs to the skeletal frame, wherein an umbrella pole holding means is provided attachable to the cross members, wherein the umbrella pole holding means includes a pair of interlocking plates, one of said plates having lugs projecting therefrom with enlarged ends, the other of said plates having arcuate grooves and adapted to be bayonet connected together when rotated to be attached.

2. A method as claimed in claim 1 wherein said umbrella pole holding means includes a tubular or rod-shaped leg mounted to the lower one of said plates.

3. A method as claimed in claim 2 where a ring with hooks is carried by said tubular or rod-shaped leg.

* * * * *